US011367377B2

(12) United States Patent
Matsueda et al.

(10) Patent No.: US 11,367,377 B2
(45) Date of Patent: Jun. 21, 2022

(54) DISPLAY DEVICE

(71) Applicants: Tianma Japan, Ltd., Kanagawa (JP); Wuhan Tianma Micro-Electronics Co., Ltd., Wuhan (CN)

(72) Inventors: Yojiro Matsueda, Kanagawa (JP); Hiroaki Kimura, Kanagawa (JP)

(73) Assignees: TIANMA JAPAN, LTD., Kanagawa (JP); Wuhan Tianma Micro-Electronics Co., Ltd., Wuhan (CN)

( * ) Notice: Subject to any disclaimer, the term of this patent is extended or adjusted under 35 U.S.C. 154(b) by 0 days.

(21) Appl. No.: 16/944,740

(22) Filed: Jul. 31, 2020

(65) Prior Publication Data

US 2021/0035484 A1 Feb. 4, 2021

(30) Foreign Application Priority Data

Aug. 2, 2019 (JP) ..... JP2019-143275
Apr. 23, 2020 (JP) ..... JP2020-076952

(51) Int. Cl.
*G09G 3/20* (2006.01)
*G09G 3/3266* (2016.01)
*G09G 3/3233* (2016.01)

(52) U.S. Cl.
CPC ..... *G09G 3/2003* (2013.01); *G09G 3/3233* (2013.01); *G09G 3/3266* (2013.01); *G09G 2300/0452* (2013.01); *G09G 2320/0233* (2013.01)

(58) Field of Classification Search
CPC ..... G09G 3/2003; G09G 2320/0209; G09G 3/2092; G09G 2320/0233; G09G 2320/0247; G09G 2320/0238; G09G 2320/0242; G09G 2300/0452; G09G 2300/0819
See application file for complete search history.

(56) References Cited

U.S. PATENT DOCUMENTS

2016/0357076 A1* 12/2016 Huangfu ..... G02F 1/13439
2018/0088260 A1 3/2018 Jin et al.
2020/0357322 A1* 11/2020 Wu ..... H01L 27/3216

* cited by examiner

*Primary Examiner* — Dennis P Joseph
(74) *Attorney, Agent, or Firm* — Sughrue Mion, PLLC

(57) ABSTRACT

The display region includes a plurality of subpixel lines. Each of the plurality of subpixel lines include subpixels of a first color, subpixel pairs of a second color, and subpixels of a third color disposed cyclically one by one along a first axis. Between two adjacent subpixel lines, subpixels of the first color are disposed at different positions along the first axis. Between the two adjacent subpixel lines, subpixel pairs of the second color are disposed at different positions along the first axis. Between the two adjacent subpixel lines, subpixels of the third color are disposed at different positions along the first axis. The centroids of two subpixels constituting a subpixel pair of the second color are located at different positions when seen along the first axis and when seen along a second axis perpendicular to the first axis.

8 Claims, 24 Drawing Sheets

COMPARATIVE EXAMPLE

DISPLAY DEVICE

CROSS-REFERENCE TO RELATED APPLICATIONS

This non-provisional application claims priority under 35 U.S.C. § 119(a) on Patent Application No. 2019-143275 filed in Japan on Aug. 2, 2019 and Patent Application No. 2020-76952 filed in Japan on Apr. 23, 2020, the entire contents of which are hereby incorporated by reference.

BACKGROUND

This disclosure relates to a display device.

The display region of a color display device is generally composed of red (R) subpixels, green (G) subpixels, and blue (B) subpixels arrayed on the substrate of a display panel. Various layouts of subpixels (pixel layouts) have been proposed; for example, RGB stripe layout and delta-nabla layout (also simply referred to as delta layout) have been known. For example, US 2018/0088260 A discloses a layout such that the number of red subpixels and the number of blue subpixels are a half of the number of green subpixels.

SUMMARY

An aspect of this disclosure is a display device including a substrate and a display region fabricated on the substrate. The display region includes a plurality of subpixel lines. Each of the plurality of subpixel lines include subpixels of a first color, subpixel pairs of a second color, and subpixels of a third color disposed cyclically one by one along a first axis. Between two adjacent subpixel lines, subpixels of the first color are disposed at different positions along the first axis. Between the two adjacent subpixel lines, subpixel pairs of the second color are disposed at different positions along the first axis. Between the two adjacent subpixel lines, subpixels of the third color are disposed at different positions along the first axis, The centroids of two subpixels constituting a subpixel pair of the second color are located at different positions when seen along the first axis and when seen along a second axis perpendicular to the first axis.

It is to be understood that both the foregoing general description and the following detailed description are exemplary and explanatory and are not restrictive of this disclosure.

EMBODIMENTS

Figure 1:
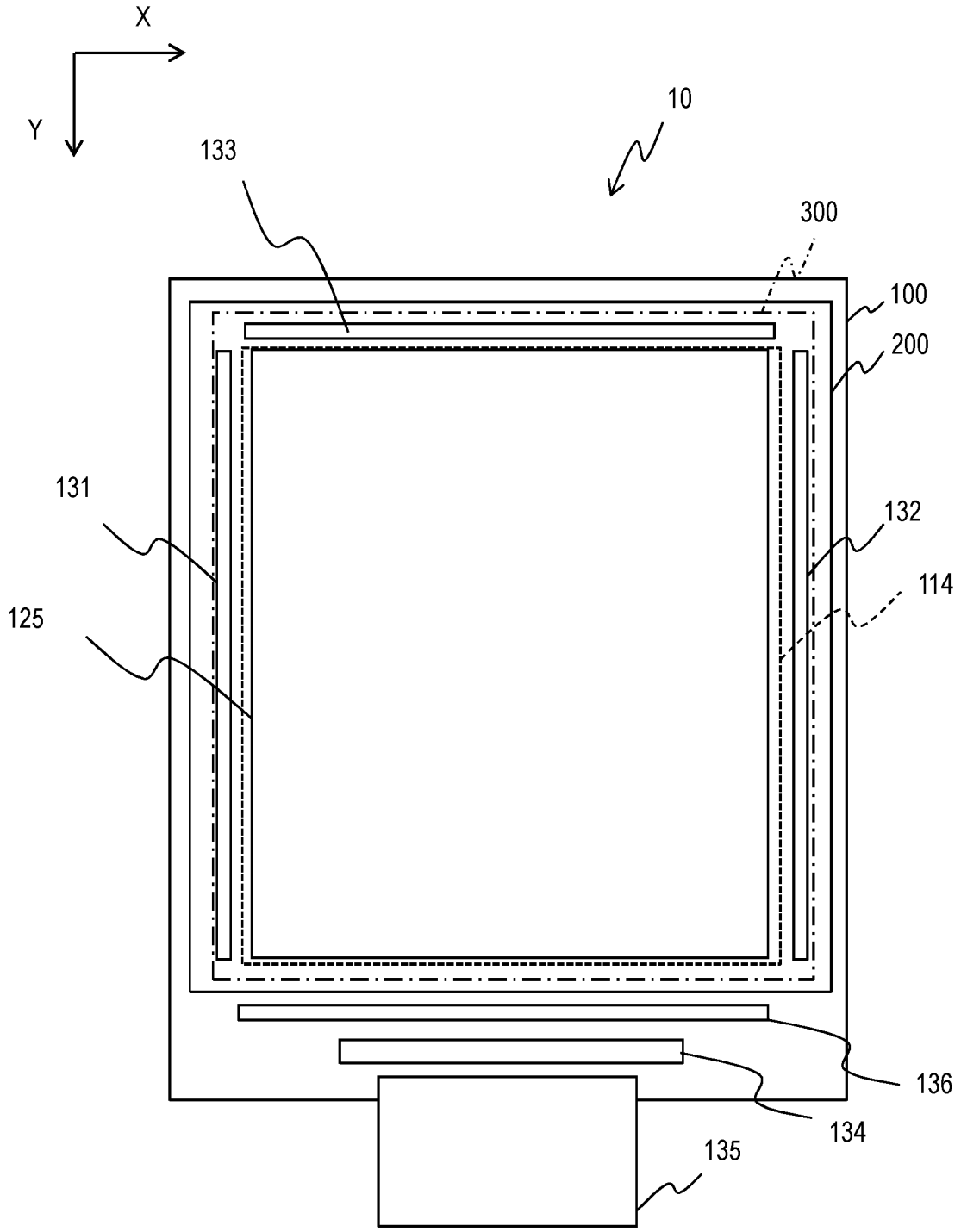
FIG. 1 schematically illustrates a configuration example of an OLED display device.

Hereinafter, embodiments of this disclosure will be described with reference to the accompanying drawings. It should be noted that the embodiments are merely examples to implement the features of this disclosure and are not to limit the technical scope of this disclosure. Elements common to the drawings are denoted by the same reference signs.

Configuration of Display Device

An overall configuration of the display device in the embodiments is described with reference to FIG. 1. The elements in the drawings may be exaggerated in size or shape for clear understanding of the description. In the following, an organic light-emitting diode (OLED) display device is described as an example of the display device; however, the features of this disclosure are applicable to display devices including any kind of self-light-emitting elements, such as micro LED display device.

FIG. 1 schematically illustrates a configuration example of an OLED display device 10. The OLED display device 10 includes an OLED display panel and a control device. The OLED display panel includes a thin film transistor (TFT) substrate 100 on which OLED elements (light-emitting elements) are formed, an encapsulation substrate 200 for encapsulating the OLED elements, and a bond (glass frit sealer) 300 for bonding the TFT substrate 100 with the encapsulation substrate 200. The space between the TFT substrate 100 and the encapsulation substrate 200 is filled with dry nitrogen, for example, and sealed up with the bond 300. Instead of hollow sealing that seals the encapsulation substrate 200 with the bond 300, thin film encapsulation (TFE) that covers the entire region of the encapsulation substrate 200 with a laminate of an inorganic film and an organic film can be employed.

In the periphery of a cathode electrode forming region 114 outer than the display region 125 of the TFT substrate 100, a scanning driver 131, an emission driver 132, a protection circuit 133, and a driver IC 134 are provided. These are connected to the external devices via flexible printed circuits (FPC) 135. The driver IC 134, the scanning driver 131, the emission driver 132, and the protection circuit 133 are included in the control device.

The scanning driver 131 drives scanning lines on the TFT substrate 100. The emission driver 132 drives emission control lines to control the light emission periods of subpixels. The protection circuit 133 protects the elements from electrostatic discharge. The driver IC 134 is mounted with an anisotropic conductive film (ACF), for example.

The driver IC 134 provides power and timing signals (control signals) to the scanning driver 131 and the emission driver 132 and further, provides signals corresponding to picture data to the data lines. In other words, the driver IC 134 has a display control function.

In FIG. 1, the axis extending from the left to the right is referred to as X-axis and the axis extending from the top to the bottom is referred to as Y-axis. Hereinafter, the pixels or subpixels disposed in a line along the X-axis within the display region 125 are referred to as a pixel row or subpixel row; the pixels or subpixels disposed in a line along the Y-axis within the display region 125 are referred to as a pixel column or subpixel column for descriptive purposes. However, the orientations of the rows and the columns are not limited to this example. The term "pixel line" is a term embracing pixel row and pixel column and the term "subpixel line" is a term embracing subpixel row and subpixel column.

Figure 2:
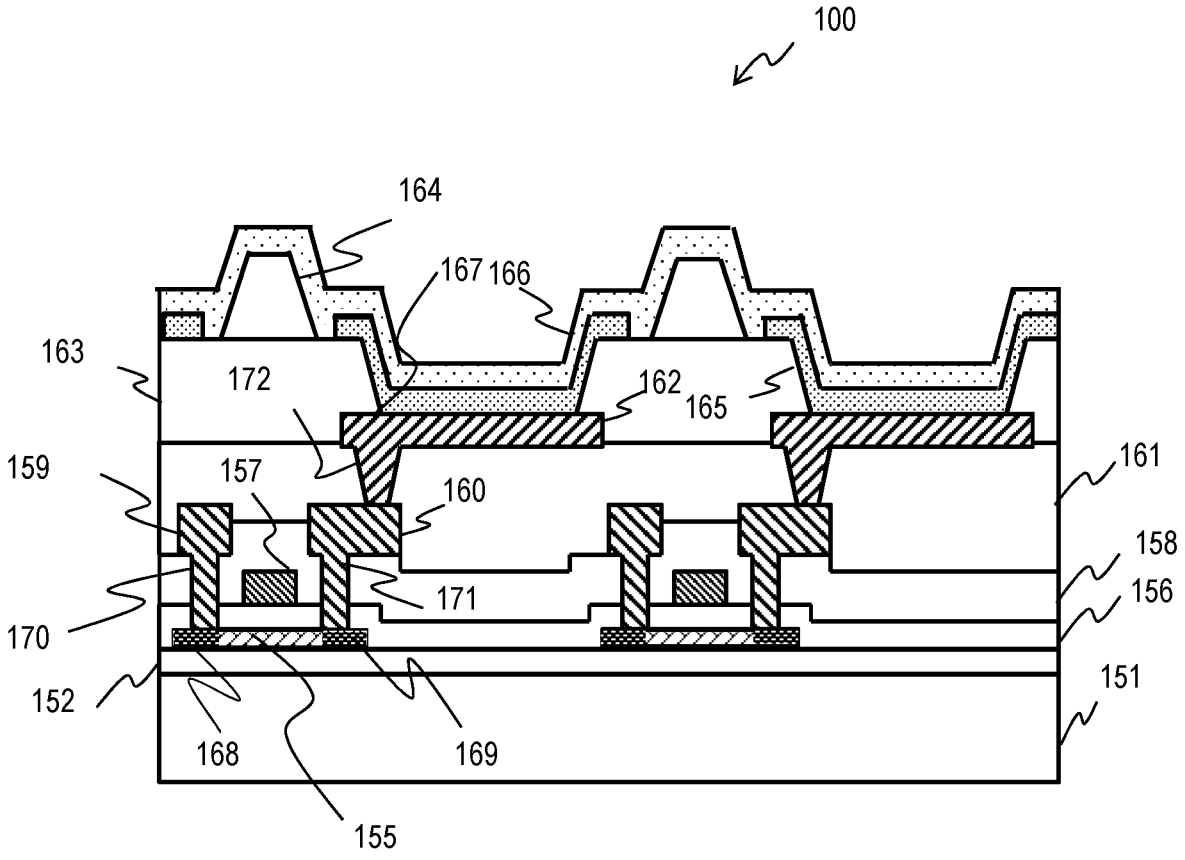
FIG. 2 illustrates an example of a pixel structure.

Next, general structures of a pixel circuit and an OLED element is described. FIG. 2 schematically illustrates a cross-sectional structure of a part of a TFT substrate 100, particularly the part including a driving TFT. The TFT substrate 100 includes an insulating substrate 151. An OLED display device 10 further includes a structural encapsulation unit opposed to the insulating substrate 151. The structural encapsulation unit is not shown in FIG. 2. An example of the structural encapsulation unit is a flexible or inflexible encapsulation substrate 200. The structural encapsulation unit can be a thin film encapsulation (TFE) structure.

The TFT substrate 100 includes lower electrodes (for example, anode electrodes 162), upper electrodes (for example, cathode electrodes 166), and organic light-emitting films 165 disposed between the insulating substrate 151 and the structural encapsulation unit.

The organic light-emitting films 165 are provided between the cathode electrodes 166 and the anode electrodes 162. The plurality of anode electrodes 162 are disposed on the same plane (for example, on a planarization film 161) and an organic light-emitting film 165 is disposed on an anode electrode 162. In the example of FIG. 2, the cathode electrode of one subpixel is a part of an unseparated conductor film. The unseparated conductor film is also referred to as cathode electrode.

The TFT substrate 100 further includes a plurality of post spacers (PS) 164 standing toward the structural encapsulation unit and a plurality of pixel circuits (circuits for subpixels) each including a plurality of switches. Each of the plurality of pixel circuits is formed between the insulating substrate 151 and an anode electrode 162 and controls the electric current to be supplied to the anode electrode 162.

FIG. 2 illustrates an example of a top-emission pixel structure, which includes top-emission type of OLED elements. The top-emission pixel structure is configured in such a manner that a cathode electrode 166 common to a plurality of pixels is provided on the light emission side (the upper side of the drawing). The cathode electrode 166 has a shape that fully covers the entire display region 125. The top-emission pixel structure is characterized by that the anode electrodes 162 have light reflectivity and the cathode electrode 166 has light transmissivity. Hence, a configuration to transmit light coming from the organic light-emitting films 165 toward the structural encapsulation unit is attained.

Compared to a bottom-emission pixel structure configured to extract light from the insulating substrate 151, the top-emission type does not need a light transmissive region within a pixel region to extract light. For this reason, the top-emission type has high flexibility in laying out pixel circuits. For example, the light-emitting unit can be provided above the pixel circuits or lines. The bottom-emission pixel structure has a transparent anode electrode and a reflective cathode electrode to emit light to the external through the insulating substrate 151. The features of this disclosure are also applicable to an OLED display device having a bottom-emission pixel structure.

A subpixel of a full-color OLED display device usually displays one of the colors of red, green, and blue. A pixel circuit including a plurality of thin film transistors controls light emission of an OLED element associated therewith. An OLED element is composed of an anode electrode of a lower electrode, an organic light-emitting film, and a cathode electrode of an upper electrode.

The insulating substrate 151 is made of glass or resin, for example, and is flexible or inflexible. A poly-silicon layer is provided above the insulating substrate 151 with an insulating film 152 interposed therebetween. The poly-silicon layer includes channels 155 at the locations where gate electrodes 157 are to be formed later. At both ends of each channel 155, source/drain regions 168 and 169 are provided. The source/drain regions 168 and 169 are doped with high-concentration impurities for electrical connection with a wiring layer thereabove.

Lightly doped drains (LDDs) doped with low-concentration impurities can be provided between the channel 155 and the source/drain region 168 and between the channel 155 and the source/drain region 169. FIG. 2 omits the LDDs to avoid complexity. Above the poly-silicon layer, gate electrodes 157 are provided with a gate insulating film 156 interposed therebetween. An interlayer insulating film 158 is provided above the layer of the gate electrodes 157.

Within the display region 125, source/drain electrodes 159 and 160 are provided above the interlayer insulating film 158. The source/drain electrodes 159 and 160 are formed of a metal having a high melting point or an alloy of such a metal. Each source/drain electrode 159 and each source/drain electrode 160 are connected with a source/drain region 168 and a source/drain region 169 of the poly-silicon layer through contact holes 170 and 171 provided in the interlayer insulating film 158 and the gate insulating film 156.

Over the source/drain electrodes 159 and 160, an insulative planarization film 161 is provided. Above the insulative planarization film 161, anode electrodes 162 are provided. Each anode electrode 162 is connected with a source/drain electrode 160 through a contact hole 172 in the planarization film 161. The TFTs of a pixel circuit are formed below the anode electrode 162.

Above the anode electrodes 162, an insulative pixel defining layer (PDL) 163 is provided to separate OLED elements. OLED elements are formed in openings 167 of the pixel defining layer 163. Insulative spacers 164 are provided on the pixel defining layer 163 to be located between anode electrodes 162 and maintain the space between the OLED elements and the encapsulation substrate 200.

Above each anode electrode 162, an organic light-emitting film 165 is provided. The organic light-emitting film 165 is in contact with the pixel defining layer 163 in the opening 167 of the pixel defining layer 163 and its periphery. A cathode electrode 166 is provided over the organic light-emitting film 165. The cathode electrode 166 is a light-transmissive electrode. The cathode electrode 166 transmits all or part of the visible light coming from the organic light-emitting film 165. The laminated film of the anode electrode 162, the organic light-emitting film 165, and the cathode electrode 166 formed in an opening 167 of the pixel defining layer 163 corresponds to an OLED element. A not-shown cap layer may be provided over the cathode electrode 166.

Manufacturing Method

An example of the method of manufacturing the OLED display device 10 is described. The method of manufacturing the OLED display device 10 first deposits silicon nitride, for example, onto an insulating substrate 151 by chemical vapor deposition (CVD) to form an insulating film 152. Next, the method forms a layer (poly-silicon layer) including channels 155 by a known low-temperature poly-silicon TFT fabrication technique.

Specifically, the method forms a poly-silicon film by depositing amorphous silicon by CVD and crystalizing the amorphous silicon by laser annealing. The method processes the poly-silicon film to have island-like shapes and dopes the source/drain regions 168 and 169 to be connected with source/drain electrodes 159 and 160 with impurities in high concentration to reduce the resistance. The poly-silicon layer reduced in resistance can also be used to connect elements within the display region 125.

Next, the method deposits silicon oxide, for example, onto the poly-silicon layer including the channels 155 by CVD to form a gate insulating film 156. Furthermore, the method deposits a metal by sputtering and patterns the metal to form a metal layer including gate electrodes 157.

The metal layer includes storage capacitor electrodes, scanning lines 106, and emission control lines, in addition to the gate electrodes 157. The metal layer may be a single layer made of one substance selected from a group consisting of Mo, W, Nb, MoW, MoNb, Al, Nd, Ti, Cu, a Cu alloy, an Al alloy, Ag, and an Ag alloy. Alternatively, the metal layer may be a laminated layer to reduce the wiring resistance. The laminated layer has a multi-layer structure including two or more layers each made of a low-resistive material selected from a group consisting of Mo, Cu, Al, and Ag.

In forming the metal layer, the method keeps offset regions to the gate electrodes 157 in the source/drain regions 168 and 169 doped with high-concentration impurities. Subsequently, the method dopes this poly-silicon film with additional impurities using the gate electrodes 157 as a mask to prepare a layer of low-concentration impurities between the source/drain regions 169 and the channels 155 located under the gate electrodes 157 and between the source/drain regions 168 and the channels 155. As a result, the TFTs has a lightly doped drain (LDD) structure. Next, the method deposits silicon oxide by CVD to form an interlayer insulating film 158.

The method opens contact holes in the interlayer insulating film 158 and the gate insulating film 156 by anisotropic etching. The contact holes 170 and 171 to connect the source/drain electrodes 159 and 160 to the source/drain regions 168 and 169 are formed in the interlayer insulating film 158 and the gate insulating film 156.

Next, the method deposits conductive films of Ti/Al/Ti, for example, by sputtering and patterns the films to form a metal layer. The metal layer includes source/drain electrodes 159 and 160 and inner coating or filling of the contact holes 170 and 171. In addition to these, data lines 105 and power lines 108 are also formed on the same layer.

Next, the method deposits a photosensitive organic material to form a planarization film 161. Subsequently, the method opens contact holes including contact holes 172 connecting to the source/drain electrodes 160 of the TFTs by exposure and development. The method forms anode electrodes 162 on the planarization film 161 having contact holes 172. An anode electrode 162 includes three layers of a transparent film made of ITO, IZO, ZnO, $In_2O_3$, or the like, a reflective film made of a metal such as Ag, Mg, Al, Pt, Pd, Au, Ni, Nd, Ir, or Cr or an alloy containing such a metal, and another transparent film as mentioned above. The three-layer structure of the anode electrode 162 is merely an example and the anode electrode 162 may have a two-layer structure. The anode electrodes 162 are connected to the source/drain electrodes 160 through the contact holes 172.

Next, the method deposits a photosensitive organic resin by spin coating and patterns the photosensitive organic resin to form a pixel defining layer 163. The patterning creates openings 167 in the pixel defining layer 163 to expose the anode electrodes 162 of the subpixels at the bottom of the created openings 167. The inner walls of the openings 167 in the pixel defining layer 163 are normally tapered. The pixel defining layer 163 forms separate light-emitting regions of subpixels. The method further deposits a photosensitive organic resin by spin coating and patterns the photosensitive organic resin to form spacers 164 on the pixel defining layer 163.

Next, the method applies organic light-emitting materials onto the insulating substrate 151 with the pixel defining layer 163 to form organic light-emitting films 165. Each organic light-emitting film 165 is formed by depositing an organic light-emitting material for the color of R, G, or B on an anode electrode 162. Forming an organic light-emitting film 165 uses a metal mask for a specific color. An organic light-emitting film 165 consists of, for example, a hole injection layer, a hole transport layer, a light-emitting layer, an electron transport layer, and an electron injection layer in this order from the bottom. The laminate structure of the organic light-emitting film 165 is determined depending on the design.

Next, the method applies a metal material for the cathode electrode 166 onto the TFT substrate 100 where the pixel defining layer 163, the spacers 164, and the organic light-emitting films 165 (in the openings of the pixel defining layer 163) are exposed. The metal material deposited on the organic light-emitting film 165 of one subpixel functions as the cathode electrode 166 of the subpixel within the region of an opening of the pixel defining layer 163.

The layer of the cathode electrode 166 is formed by vapor-deposition of a metal such as Al or Mg or an alloy thereof, for example. If the resistance of the cathode electrode 166 is so high to impair the uniformity of the luminance of the emitted light, an additional auxiliary electrode layer may be formed using a material for a transparent electrode, such as ITO, IZO, ZnO, or $In_2O_3$.

Pixel Circuit

Figure 3A:
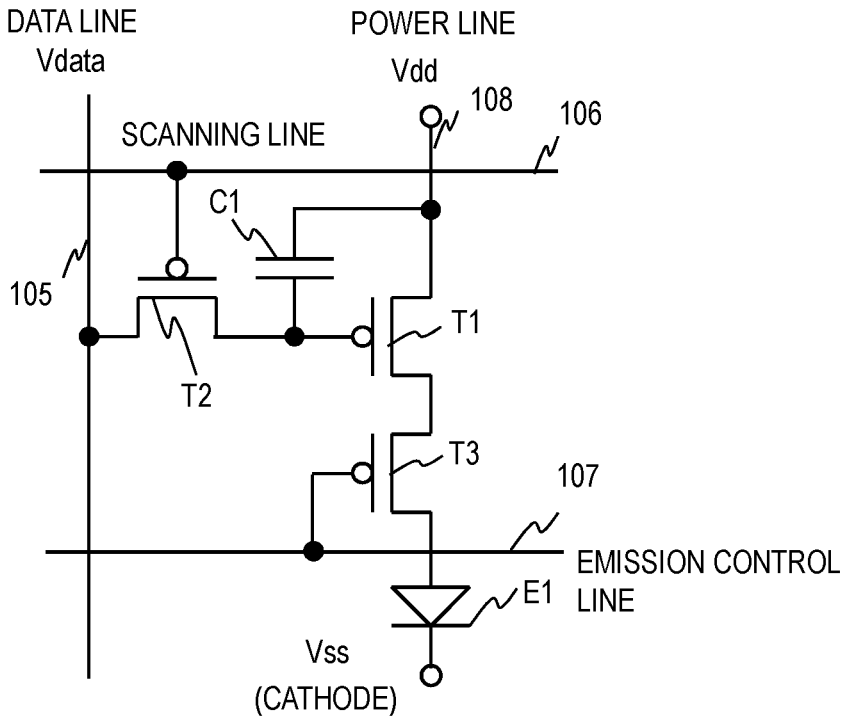
FIG. 3A illustrates an example of a pixel circuit.

A plurality of pixel circuits are formed on the TFT substrate 100 to control electric current to be supplied to the anode electrodes of subpixels. FIG. 3A illustrates a configuration example of a pixel circuit. Each pixel circuit includes a driving transistor T1, a selection transistor T2, an emission transistor T3, and a storage capacitor C1. The pixel circuit controls light emission of an OLED element E1. The transistors are TFTs.

The selection transistor T2 is a switch for selecting the subpixel. The selection transistor T2 is a p-channel TFT and its gate terminal is connected with a scanning line 106. The source terminal is connected with a data line 105. The drain terminal is connected with the gate terminal of the driving transistor T1.

The driving transistor T1 is a transistor (driving TFT) for driving the OLED element E1. The driving transistor T1 is a p-channel TFT and its gate terminal is connected with the drain terminal of the selection transistor T2. The source terminal of the driving transistor T1 is connected with a power line (Vdd) 108. The drain terminal is connected with the source terminal of the emission transistor T3. The storage capacitor C1 is provided between the gate terminal and the source terminal of the driving transistor T1.

The emission transistor T3 is a switch for controlling supply/stop of the driving current to the OLED element E1. The emission transistor T3 is a p-channel TFT and its gate terminal is connected with an emission control line 107. The source terminal of the emission transistor T3 is connected with the drain terminal of the driving transistor T1. The drain terminal of the emission transistor T3 is connected with the OLED element E1.

Next, operation of the pixel circuit is described. The scanning driver 131 outputs a selection pulse to the scanning line 106 to turn on the selection transistor T2. The data voltage supplied from the driver IC 134 through the data line 105 is stored to the storage capacitor C1. The storage capacitor C1 holds the stored voltage during the period of one frame. The conductance of the driving transistor T1 changes in an analog manner in accordance with the stored voltage, so that the driving transistor T1 supplies a forward bias current corresponding to a light emission level to the OLED element E1.

The emission transistor T3 is located on the supply path of the driving current. The emission driver 132 outputs a control signal to the emission control line 107 to control ON/OFF of the emission transistor T3. When the emission transistor T3 is ON, the driving current is supplied to the OLED element E1. When the emission transistor T3 is OFF, this supply is stopped. The lighting period (duty ratio) in the period of one frame can be controlled by controlling ON/OFF of the transistor T3.

Figure 3B:
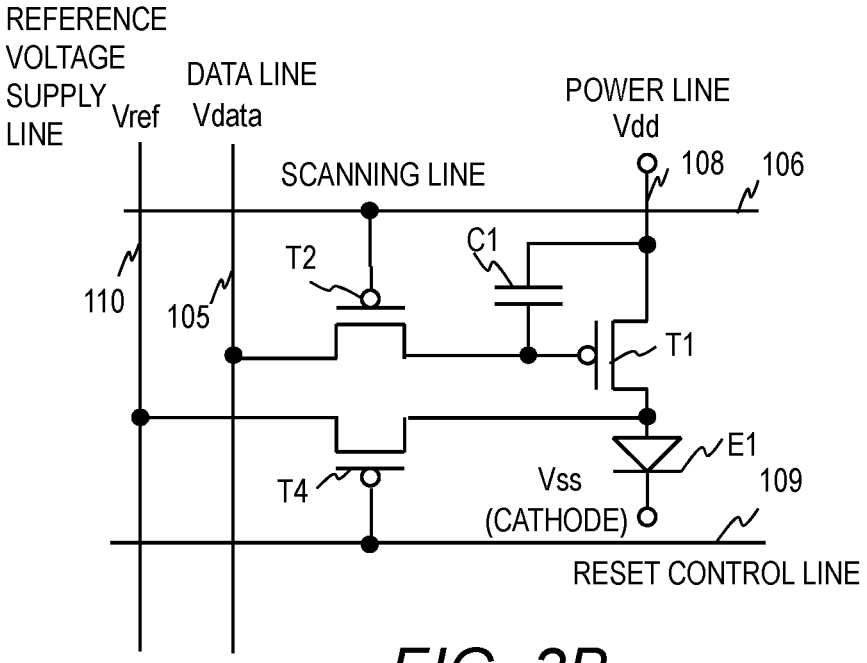
FIG. 3B illustrates another example of a pixel circuit.

FIG. 3B illustrates another configuration example of a pixel circuit. This pixel circuit includes a reset transistor T4 in place of the emission transistor T3 in FIG. 3A. The reset transistor T4 controls the electric connection between a reference voltage supply line 110 and the anode of the OLED element E1. This control is performed in accordance with a reset control signal supplied from the emission driver 132 to the gate of the reset transistor T4 through a reset control line 109.

The reset transistor T4 can be used for various purposes. For example, the reset transistor T4 can be used to reset the anode electrode of the OLED element E1 once to a sufficiently low voltage that is lower than the black signal level to prevent crosstalk caused by leakage current between OLED elements E1.

The reset transistor T4 can also be used to measure a characteristic of the driving transistor T1. For example, the voltage-current characteristic of the driving transistor T1 can be accurately measured by measuring the current flowing from the power line (Vdd) 108 to the reference voltage supply line (Vref) 110 under the bias conditions selected so that the driving transistor T1 will operate in the saturated region and the reset transistor T4 will operate in the linear region. If the differences in voltage-current characteristic among the driving transistors T1 for individual subpixels are compensated for by generating data signals at an external circuit, a highly-uniform display image can be attained.

In the meanwhile, the voltage-current characteristic of the OLED element E1 can be accurately measured by applying a voltage to light the OLED element E1 from the reference voltage supply line 110 when the driving transistor T1 is off and the reset transistor T4 is operating in the linear region. In the case where the OLED element E1 is deteriorated because of long-term use, for example, if the deterioration is compensated for by generating a data signal at an external circuit, the display device can have a long life spun.

The circuit configurations in FIGS. 3A and 3B are examples; the pixel circuit may have a different circuit configuration. Although the pixel circuits in FIGS. 3A and 3B include p-channel TFTs, the pixel circuit may employ n-channel TFTs.

Pixel Layout in Delta-Nabla Panel

Figure 4:
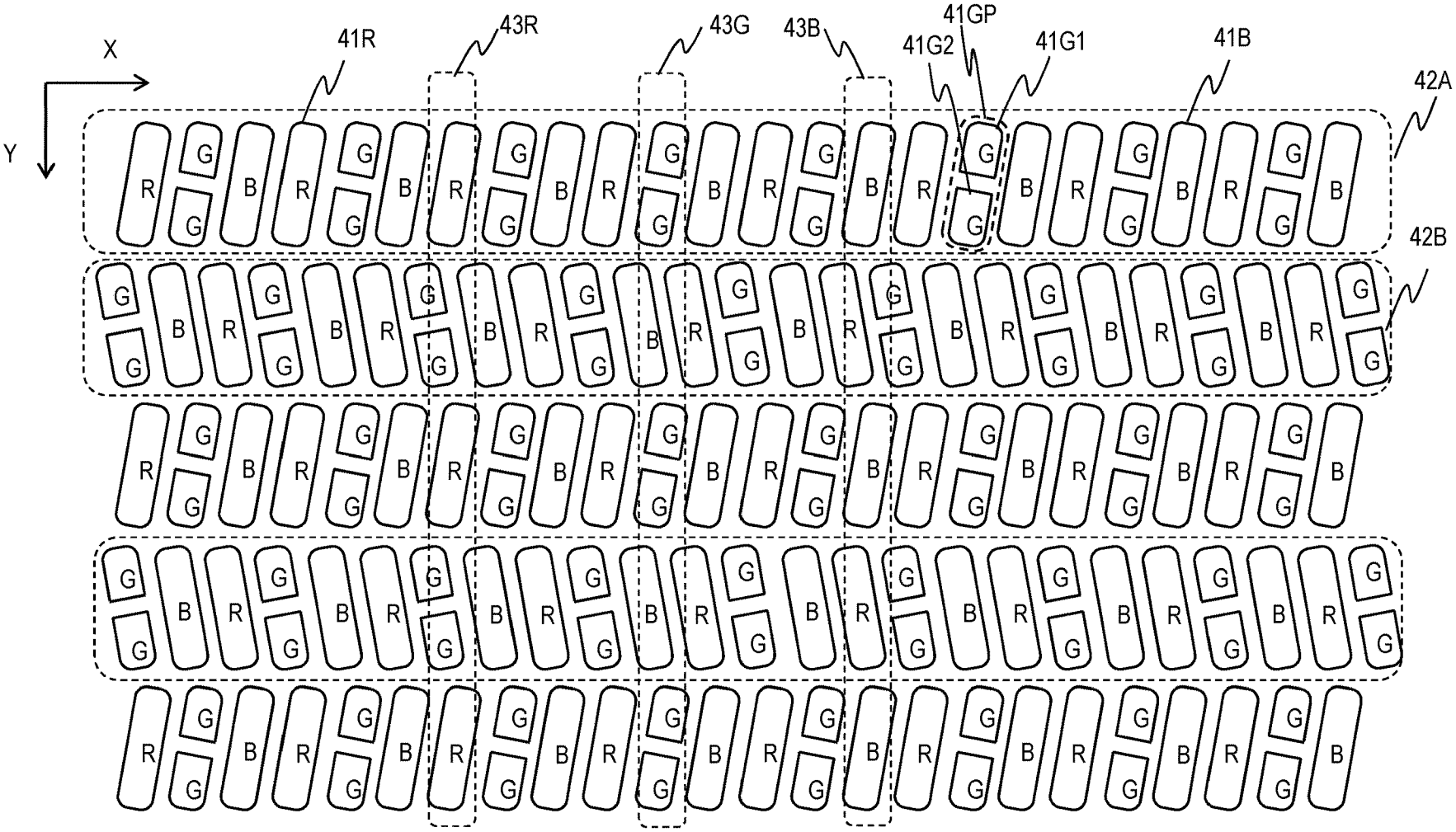
FIG. 4 illustrates a subpixel layout in a delta-nabla panel in an embodiment.

FIG. 4 illustrates a subpixel layout in a delta-nabla panel in this embodiment. The display region 125 of the delta-nabla panel is composed of subpixels disposed in a delta-nabla layout. The delta-nabla layout can have a large distance between light-emitting regions (organic light-emitting films) for the same color of light. Accordingly, the metal masks can have a large distance between openings. In this disclosure, two green subpixels are disposed in one opening of a metal mask for green subpixels. This configuration achieves low resolution of the metal mask pattern while attaining high spatial resolution of green subpixels having high visibility, and therefore, avoids decrease in yield caused by deformation of a metal mask or particles attached on the metal mask while ensuring sufficient display resolution.

FIG. 4 schematically illustrates a part of the display region 125. The display region 125 is composed of a plurality of red subpixels 41R, a plurality of green subpixel pairs 41GP, and a plurality of blue subpixels 41B disposed in a plane. A green subpixel pair 41GP consists of two green subpixels 41G1 and 41G2 disposed in the same opening of the metal mask for green subpixels.

A given green subpixel is referred to as green subpixel 41G. Each subpixel corresponds to the light-emitting region of an OLED element and the luminance of the subpixel is controlled independently.

In FIG. 4, one of the red subpixels, one of the green subpixel pairs, and one of the blue subpixels are provided with reference signs by way of example. The rounded rectangles denoted by R represent red subpixels; partially rounded rectangles denoted by G represent green subpixels; and rounded rectangles denoted by B represent blue subpixels.

Although the subpixels in FIG. 4 have rectangular shapes, subpixels may have desired shapes, such as hexagonal or octagonal shapes. Among red, green, and blue, green has the highest relative visibility and blue has the lowest. A color display device has three colors of subpixels, but the combination of the first color, the second color, and the third color can be different from the combination of red, green, and blue.

The display region 125 includes a plurality of subpixel columns extending along the Y-axis (the second axis) and disposed side by side along the X-axis (the first axis). In FIG. 4, one of the red subpixel columns is provided with a reference sign 43R, one of the green subpixel columns is provided with a reference sign 43G, and one of the blue subpixel columns is provided with a reference sign 43B, by way of example. The X-axis and the Y-axis are perpendicular to each other within the plane where the subpixels are disposed. The X-direction is one of the two opposite directions along the X-axis and is directed from the left to the right of FIG. 4. The Y-direction is one of the two opposite directions along the Y-axis and is directed from the top to the bottom of FIG. 4.

In the example of FIG. 4, each subpixel column is composed of subpixels of the same color disposed at a predetermined pitch. Specifically, each subpixel column 43R is composed of red subpixels 41R disposed along the Y-axis; each subpixel column 43B is composed of blue subpixels 41B disposed along the Y-axis; and each subpixel column 43G is composed of green subpixel pairs 41GP (green subpixels 41G) disposed along the Y-axis. The centroids of the subpixels or subpixel pairs in a subpixel column are located on a straight line parallel to the Y-axis but the centroids can be off the line.

The red subpixel columns 43R, the blue subpixel columns 43B, and the green subpixel columns 43G are cyclically disposed along the X-axis. That is to say, a subpixel column is sandwiched between subpixel columns of the other two colors. For example, a green subpixel column 43G is disposed between a red subpixel column 43R and a blue subpixel column 43B. In the example of FIG. 4, a red subpixel column 43R, a blue subpixel column 43B, and a green subpixel column 43G are disposed in this order and this cycle is repeated. The order of color in a cycle can be different from this example.

Two adjacent subpixel columns are disposed at different positions along the Y-axis. In other words, when seen along the X-axis, two adjacent subpixel columns are different in position. That is to say, each subpixel in a subpixel column (or each green subpixel pair of a green subpixel column) is located between two adjacent subpixels or subpixel pairs in the next subpixel column. In the example of FIG. 4, each subpixel column is shifted by a half pitch with respect to the next subpixel column. One pitch is a distance between red subpixels, blue subpixels, or green subpixel pairs adjacent to each other in a subpixel column.

Each subpixel or subpixel pair included in the first subpixel column is located at the middle between two adjacent subpixels in either subpixel column adjacent to the first subpixel column, when seen along the X-axis. For example, the centroid of a green subpixel pair 41GP is located at the middle between two red subpixels 41R in the adjacent red subpixel column on one side and at the middle between two blue subpixels 41B in the adjacent blue subpixel column on the opposite side.

The display region 125 includes a plurality of subpixel rows extending along the X-axis and disposed one above another along the Y-axis. In FIG. 4, two subpixel rows adjacent to each other are provided with reference signs 42A and 42B, by way of example. A subpixel row is composed of red subpixels 41R, blue subpixels 41B, and green subpixel pairs 41GP disposed along the X-axis.

Each subpixel row is composed of red subpixels 41R, green subpixel pairs 41G, and blue subpixels 41B cyclically disposed at a predetermined pitch. In the example of FIG. 4, a red subpixel 41R, a green subpixel pair 41GP, and a blue subpixel 41B are disposed in this order and this cycle is repeated in the X-direction (the direction from the left to the right in FIG. 4). The order of color can be different from this example.

Two adjacent subpixel rows are disposed at different positions along the X-axis. In other words, two adjacent subpixel rows are different in position when seen along the Y-axis. When subpixels of the same color are taken out separately, the red subpixels 41R in a subpixel row and the red subpixels 41R in the next subpixel row are different in position along the X-axis; the green subpixel pairs 41GP (green subpixels 41G) in a subpixel row and the green subpixel pairs 41GP (green subpixels 41G) in the next subpixel row are different in position along the X-axis; and the blue subpixels 41B in a subpixel row and the blue subpixels 41B in the next subpixel row are different in position along the X-axis.

Each of the red subpixels 41R, blue subpixels 41B, and green subpixel pairs 41GP included in the first subpixel row is located between subpixels of the other two colors or between a subpixel and a subpixel pair of the other two colors included in the subpixel row next to the first subpixel row. In the example of FIG. 4, each subpixel row is shifted by a half pitch with respect to the next subpixel row. One pitch is a distance along the X-axis between subpixels or subpixel pairs of the same color.

When subpixels of the same color are taken out separately and seen along the Y-axis, a red subpixel 41R is located between (in the example of FIG. 4, at the middle between) two adjacent red subpixels 41R in the next subpixel row, a blue subpixel 41B is located between (in the example of FIG. 4, at the middle between) two adjacent blue subpixels 41B in the next subpixel row, and a green subpixel pair 41GP is located between (in the example of FIG. 4, at the middle between) two adjacent green subpixel pairs 41GP in the next subpixel row.

In this embodiment, a subpixel line extending along the X-axis is referred to as subpixel row and a subpixel line extending along the Y-axis is referred to as subpixel column for descriptive purposes; however, the orientations of the subpixel rows and the subpixel columns are not limited to these examples.

Figure 5:
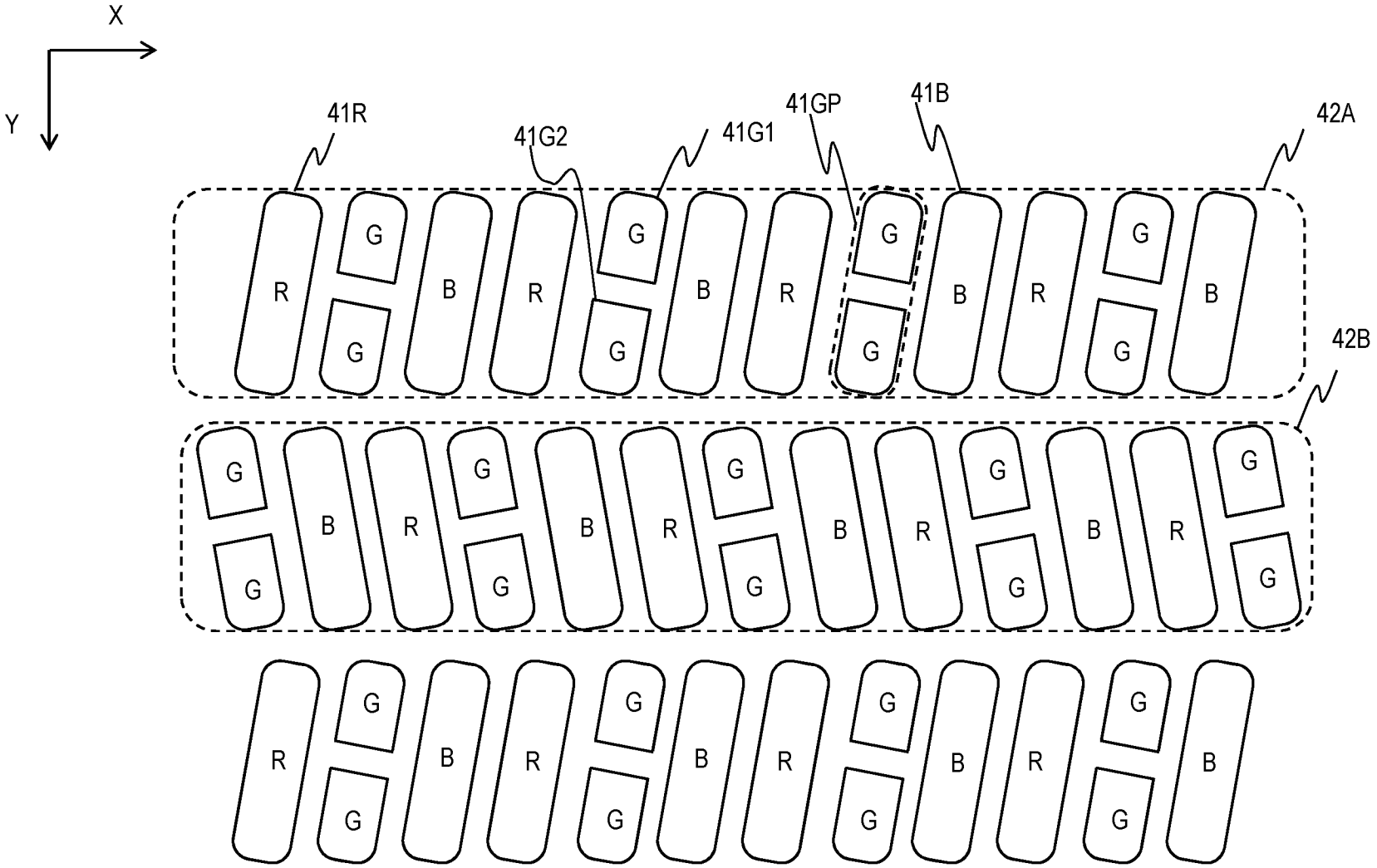
FIG. 5 illustrates a layout of subpixels included in a part of the display region.

FIG. 5 illustrates a layout of subpixels included in a part of the display region 125. In each subpixel row, red subpixels 41R, blue subpixels 41B, and green subpixel pairs 41GP are tilted with respect to the Y-axis and the X-axis. In the example of FIG. 5, the red subpixels 41R, blue subpixels 41B, and green subpixel pairs 41GP of the subpixel row 42A are tilted right with respect to the Y-axis; the red subpixels 41R, blue subpixels 41B, and green subpixel pairs 41GP of the subpixel row 42B are tilted left with respect to the Y-axis. Between pixel rows adjacent to each other, the subpixels or subpixel pairs are tilted in the opposite directions with respect to the Y-axis. This configuration improves the display quality. In another example, the subpixels in adjacent rows can be tilted in the same direction.

In the example of FIG. 5, a region consisting of green subpixels 41G1 and 41G2 and the region therebetween has a shape identical to the shapes of a red subpixel 41R and a blue subpixel 41B; however, these regions can have different shapes. In the example of FIG. 5, the distances between the centroids (the centroids of luminance or light-emitting region) of subpixels adjacent to each other in a subpixel row and the distances between the centroids of a subpixel and a subpixel pair adjacent to each other in a subpixel row are all equal; however, these distances do not need to be equal.

The centroid of a green subpixel pair 41GP is the center between the centroids of two green subpixels 41G1 and 41G2. In the example of FIG. 5, the centroids of the subpixels 41R, the blue subpixels 41B, and the green subpixel pairs 41GP in a subpixel row are located on a straight line along the X-axis. In another example, these centroids can be off the straight line along the X-axis.

Figure 6A:
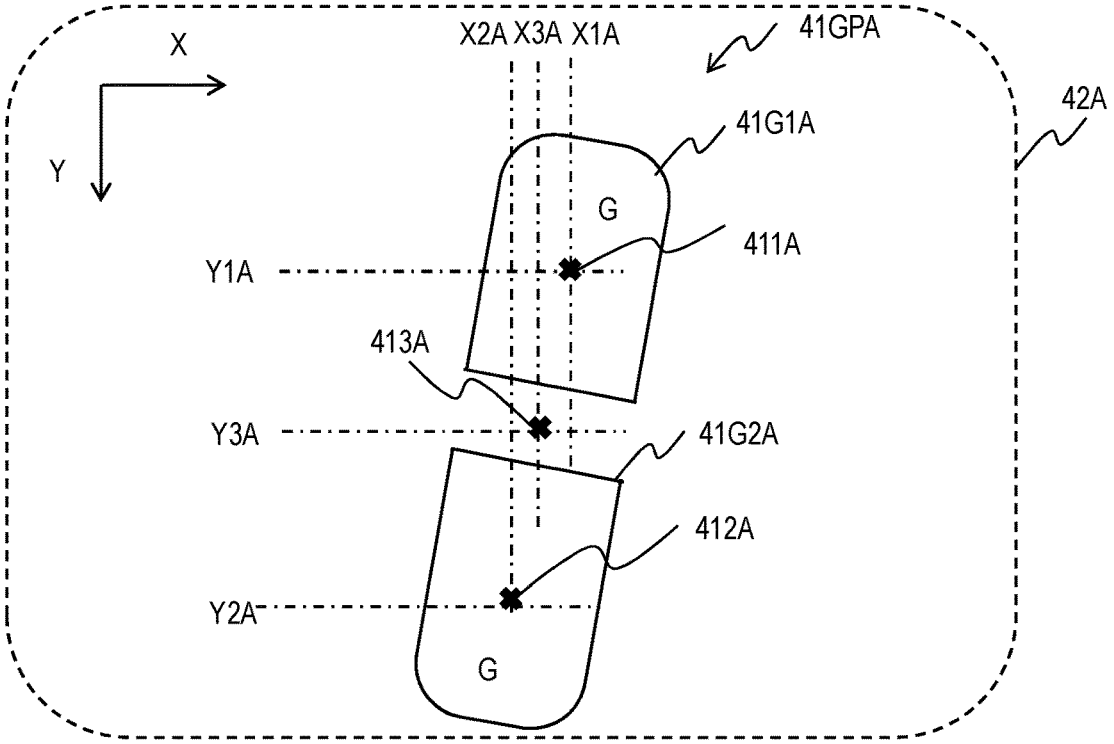
FIG. 6A illustrates a configuration of a green subpixel pair included in a subpixel row in FIG. 5.
Figure 6B:
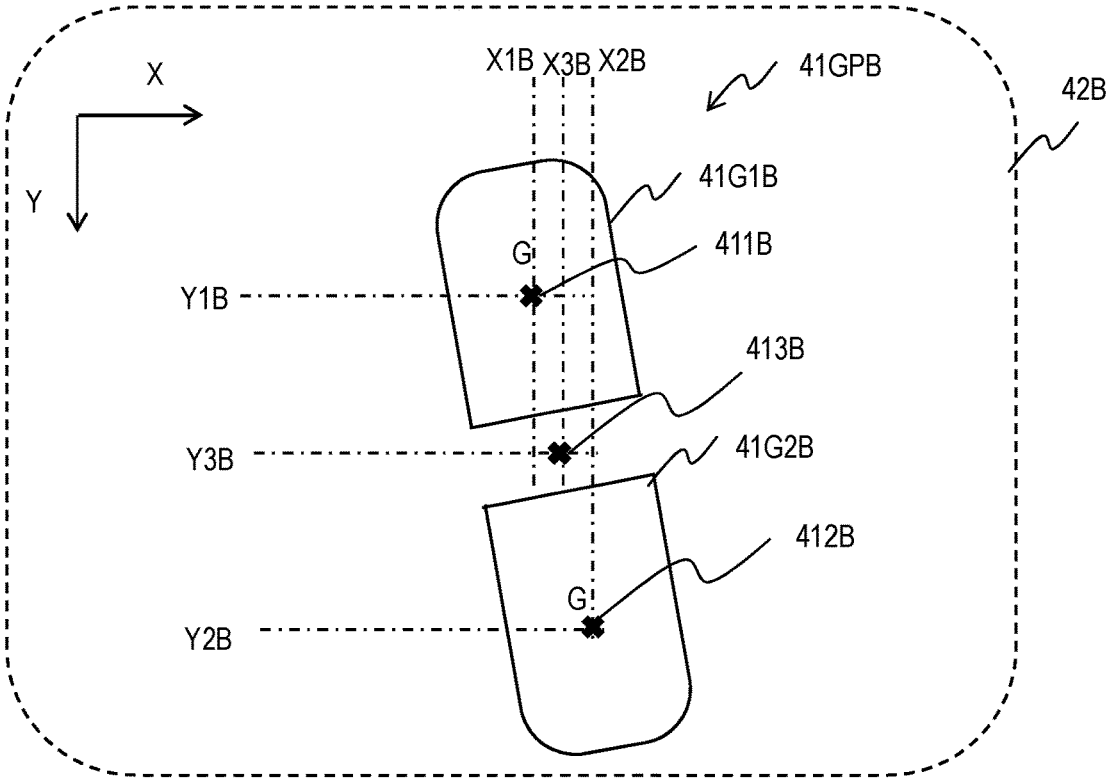
FIG. 6B illustrates a configuration of a green subpixel pair included in another subpixel row in FIG. 5.

FIG. 6A illustrates a configuration of a green subpixel pair 41GPA included in the subpixel row 42A in FIG. 5. FIG. 6B illustrates a configuration of a green subpixel pair 41GPB included in the subpixel row 42B in FIG. 5. As illustrated in FIG. 6A, the green subpixel pair 41GPA consists of a green subpixel (first green subpixel) 41G1A and a green subpixel (second green subpixel) 41G2A disposed (separated) along the Y-axis. As illustrated in FIG. 6B, the green subpixel pair 41GPB consists of a green subpixel (first green subpixel) 41G1B and a green subpixel (second green subpixel) 41G2B disposed (separated) along the Y-axis. In the example of FIGS. 6A and 6B, two green subpixels constituting a green subpixel pair have the identical shapes.

In FIG. 6A, the green subpixel 41G1A has a centroid 411A and the green subpixel 41G2A has a centroid 412A. The midpoint between the centroids 411A and 412A is the centroid 413A of the green subpixel pair 41GPA. In FIG. 6A, the green subpixel 41G1A is disposed upper than the green subpixel 41G2A; the green subpixels 41G1A and 41G2A are point-symmetric about the centroid 413A of the green subpixel pair 41GPA.

In FIG. 6B, the green subpixel 41G1B has a centroid 411B and the green subpixel 41G2B has a centroid 412B. The midpoint between the centroids 411B and 412B is the centroid 413B of the green subpixel pair 41GPB. In FIG. 6B, the green subpixel 41G1B is disposed upper than the green subpixel 41G2B; the green subpixels 41G1B and 41G2B are point-symmetric about the centroid 413B of the green subpixel pair 41GPB.

As illustrated in FIG. 6A, the centroid 411A of the green subpixel 41G1A and the centroid 412A of the green subpixel 41G2A are located at different positions when seen along the X-axis and also, when seen along the Y-axis. In FIG. 6A, the centroid 411A has a coordinate of X1A on the X-axis and a coordinate of Y1A on the Y-axis. The centroid 412A has a coordinate of X2A on the X-axis and a coordinate of Y2A on the Y-axis. The centroid 413A has a coordinate of X3A on the X-axis and a coordinate of Y3A on the Y-axis.

The coordinates X1A, X2A, and X3A are different values and the coordinates Y1A, Y2A, and Y3A are different values.

As illustrated in FIG. 6B, the centroid 411B of the green subpixel 41G1B and the centroid 412B of the green subpixel 41G2B are located at different positions when seen along the X-axis and also, when seen along the Y-axis. In FIG. 6B, the centroid 411B has a coordinate of X1B on the X-axis and a coordinate of Y1B on the Y-axis. The centroid 412B has a coordinate of X2B on the X-axis and a coordinate of Y2B on the Y-axis. The centroid 413B has a coordinate of X3B on the X-axis and a coordinate of Y3B on the Y-axis. The coordinates X1B, X2B, and X3B are different values and the coordinates Y1B, Y2B, and Y3B are different values.

In the subpixel row 42A in FIG. 6A, the centroid 411A of the green subpixel 41G1A is located on the left and the centroid 412A of the green subpixel 41G2A is located on the right when seen in the X-direction (the direction from the left to the right in FIG. 6A). The centroid 411A is located on the left and the centroid 412A is located on the right when seen in the Y-direction (the direction from the top to the bottom in FIG. 6A).

In the subpixel row 42B in FIG. 6B, the centroid 411B of the green subpixel 41G1B is located on the left and the centroid 412B of the green subpixel 41G2B is located on the right when seen in the X-direction (the direction from the left to the right in FIG. 6B). The centroid 411B is located on the right and the centroid 412B is located on the left when seen in the Y-direction (the direction from the top to the bottom in FIG. 6B).

The points described with reference to FIGS. 6A and 6B are applicable to the shapes of the red subpixels 41R and the blue subpixels 41B in the same rows. Assuming that each red subpixel 41R or each blue subpixel 41B is separated along the X-axis passing through the centroid of the red subpixel 41R or the blue subpixel 41B, one part corresponds to the green subpixel 41G1A or 41G1B and the other part corresponds to the green subpixel 41G2A or 41G2B. The foregoing description is applicable to the centroids of the separate parts.

Between subpixel rows adjacent to each other, the centroids of green subpixels constituting a green subpixel pair are located at opposite positions when seen along the Y-axis, as illustrated in FIGS. 6A and 6B. The same applies to the centroids defined by separating red subpixels and blue subpixels. This configuration increases color mixture effect of subpixels to improve the display quality.

Figure 7:
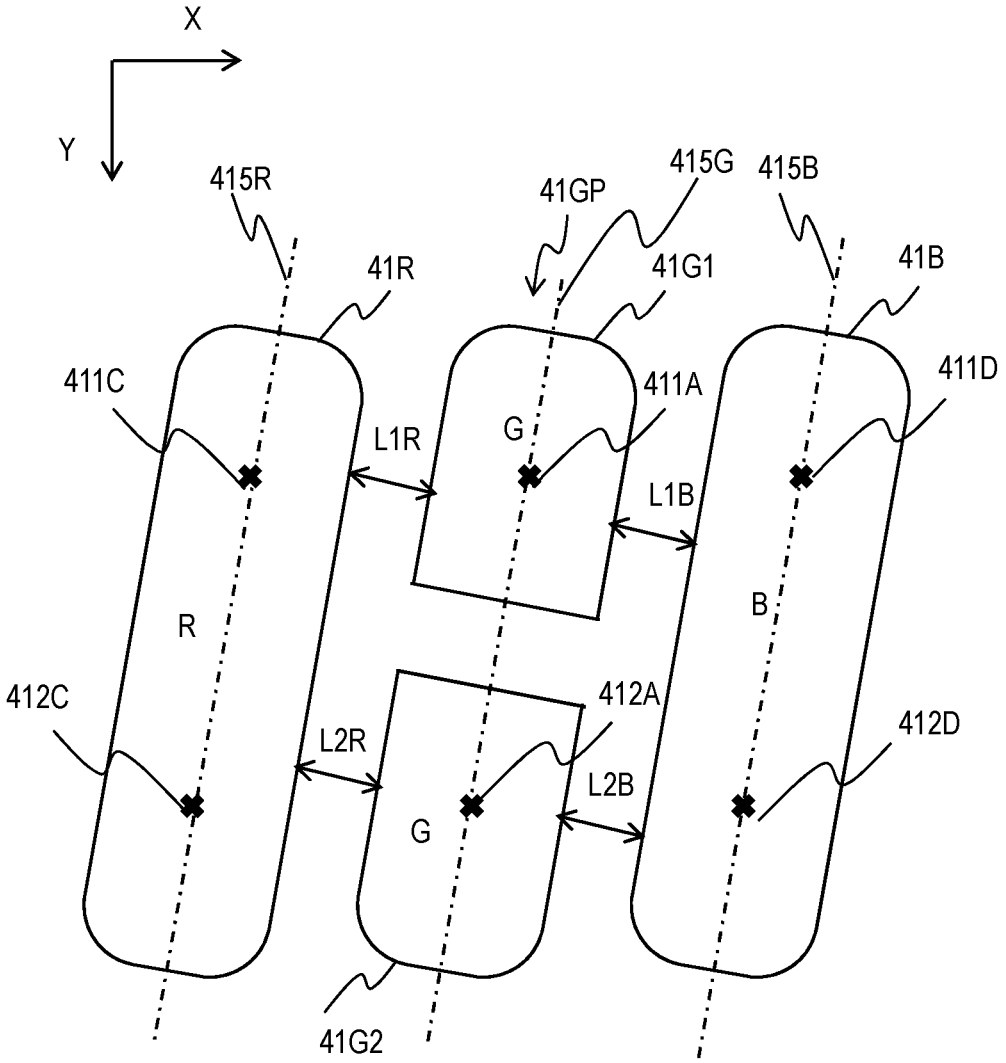
FIG. 7 illustrates relations of a green subpixel pair with a red subpixel and a blue subpixel adjacent to the green subpixel pair in a subpixel row.

FIG. 7 illustrates relations of a green subpixel pair 41GP with a red subpixel 41R and a blue subpixel 41B adjacent to the green subpixel pair 41GP in the subpixel row 42A. The line 415R is a line passing through the centroids 411C and 412C of the upper part and the lower part obtained by separating the red subpixel 41R along the line parallel to the X-axis passing through the centroid of the red subpixel 41R. The line 415G is a line passing through the centroids 411A and 412A of the two green subpixels 41G1 and 41G2. The line 415B is a line passing through the centroids 411D and 412D of the upper part and the lower part obtained by separating the blue subpixel 41B along the line parallel to the X-axis passing through the centroid of the blue subpixel 41B. In the configuration example in FIG. 7, the lines 415R, 415G, and 415B are parallel to one another and tilted with respect to the Y-axis.

In the configuration example in FIG. 7, the distance L1R between the green subpixel 41G1 and the red subpixel 41R is equal to the distance L2R between the green subpixel 41G2 and the red subpixel 41R. The distance L1B between the green subpixel 41G1 and the blue subpixel 41B is equal to the distance L2B between the green subpixel 41G2 and the blue subpixel 41B. This configuration enables the subpixels (light-emitting regions) to have a maximum size.

Figure 8:
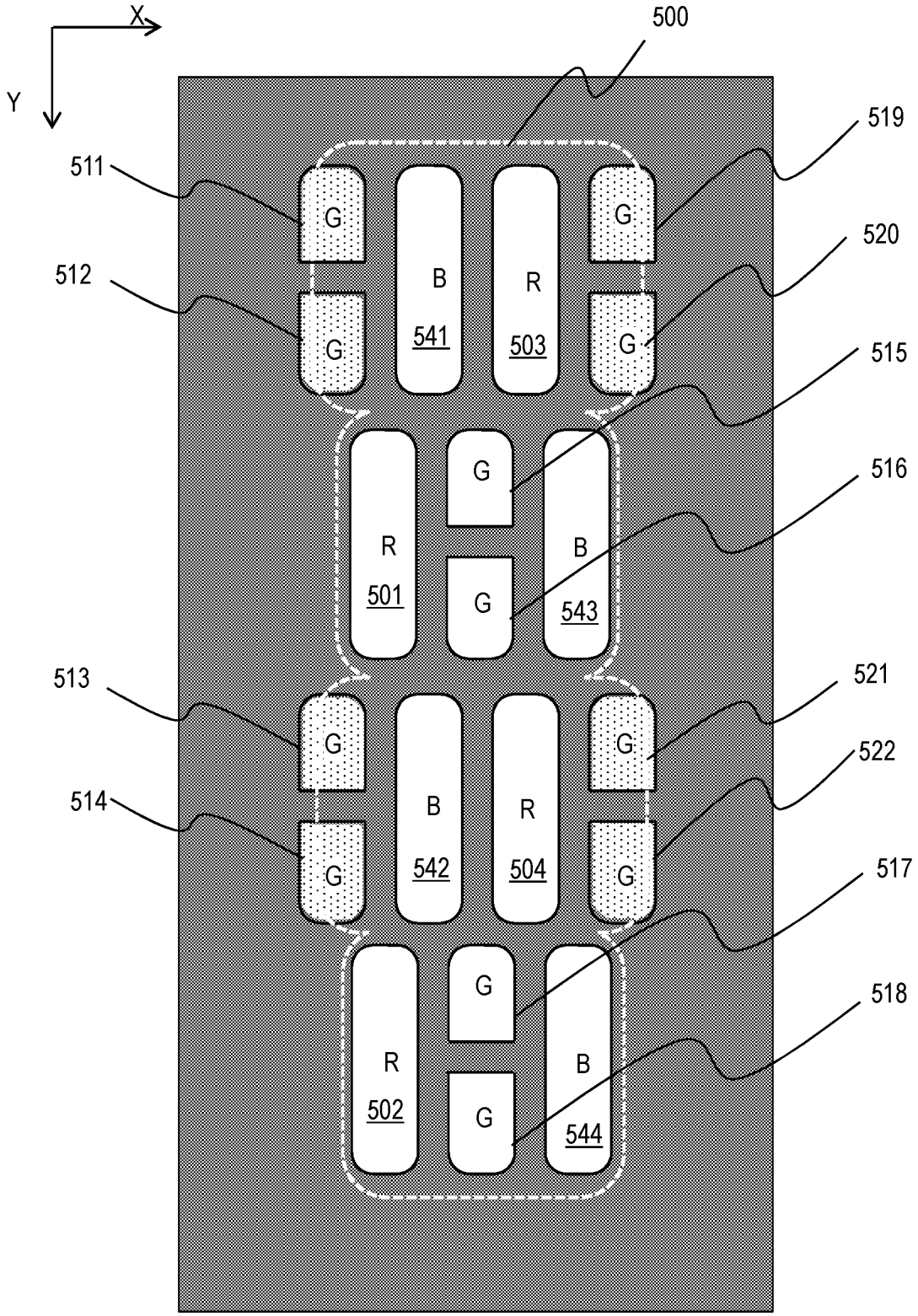
FIG. 8 schematically illustrates a subpixel layout of a comparative example and a white line along the Y-axis displayed with the subpixels of the comparative example.

Hereinafter, examples of displaying a white line along the Y-axis are described. FIG. 8 schematically illustrates a subpixel layout of a comparative example and a white line along the Y-axis displayed with the subpixels of the comparative example. The subpixel layout of the comparative example is a delta-nabla layout and the subpixels are not tilted with respect to the Y-axis. The remaining is the same as the layout illustrated in FIG. 5.

In the example of FIG. 8, a white line 500 is composed of a plurality of lighting subpixels, which are red subpixels 501 to 504, green subpixels 511 to 522, and blue subpixels 541 to 544. Each of the red subpixels 501 to 504, the blue subpixels 541 to 544, and the green subpixels 515 to 518 in the middle column is lighted at predetermined luminance to display white. The green subpixels 511 to 514 in the left column and the green subpixels 519 to 522 in the right column are lighted at the same luminance, which is lower than the luminance of the green subpixels 515 to 158 in the middle column.

In the comparative example, the distance along the X-axis between a green subpixel in the middle column and a green subpixel in the column on either side is large, and therefore, the resolution in the direction along the X-axis is low. For example, the thickness of the white line 500 can be seen as non-uniform. Specifically, the parts including green subpixels in the columns on both sides are seen as thick and the parts including green subpixels in the middle column are seen as thin.

Figure 9:
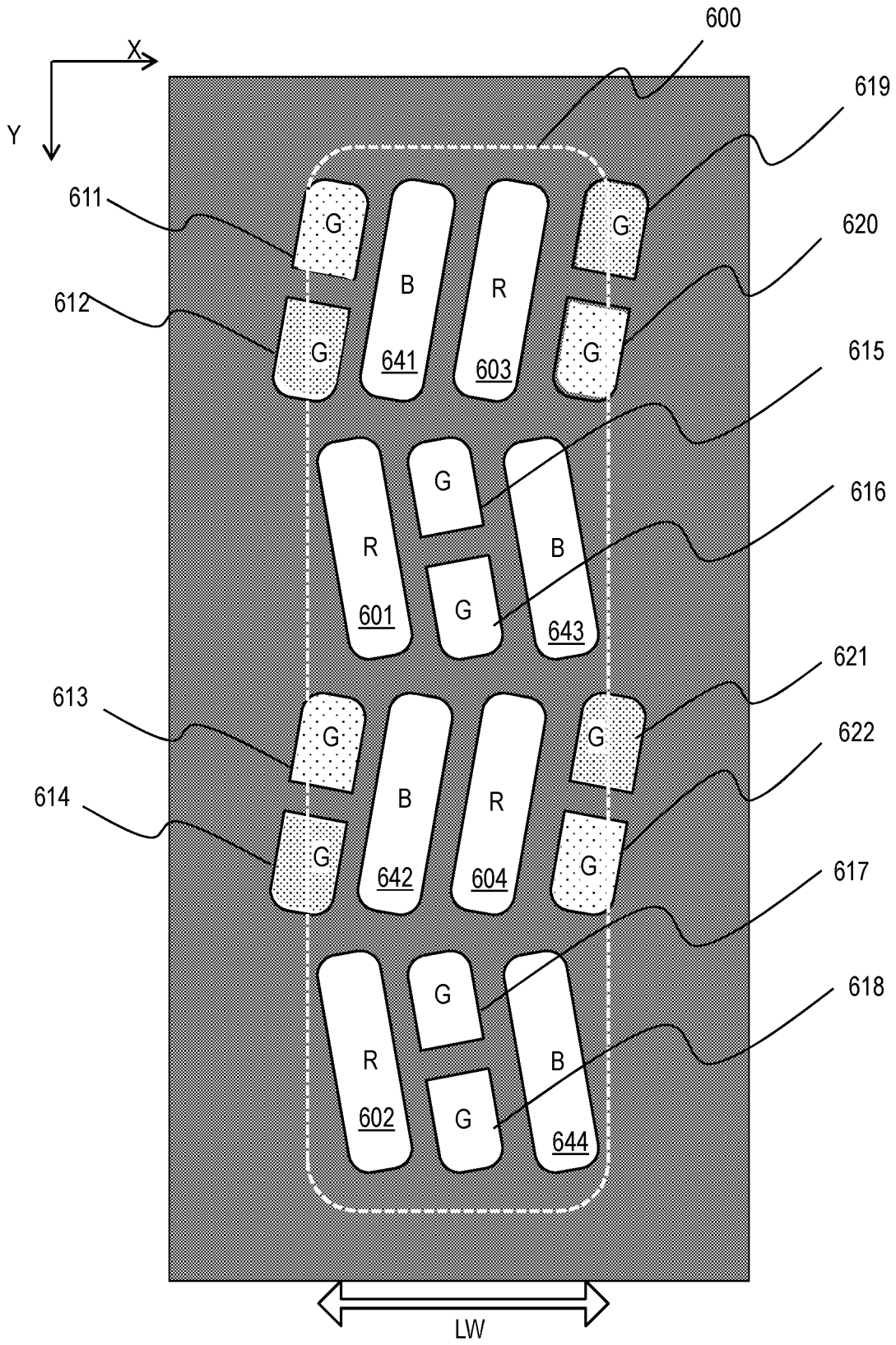
FIG. 9 illustrates an example of a white line extending along the Y-axis in the subpixel layout in this embodiment.

FIG. 9 illustrates an example of a white line extending along the Y-axis in the subpixel layout in this embodiment. The subpixel layout in FIG. 9 is the same as the layout described with reference to FIGS. 4 to 7. In the example in FIG. 9, the white line 600 having a line width LW is composed of a plurality of lighting subpixels in two red subpixel columns, three green subpixel columns, and two blue subpixel columns adjacent to one another. The subpixels included in the white line 600 are red subpixels 601 to 604, green subpixels 611 to 622, and blue subpixels 641 to 644.

The white line 600 is composed of a plurality of subpixel groups disposed consecutively along the Y-axis; each subpixel group consists of a red subpixel, a blue subpixel, and one or two green subpixel pairs in the same subpixel row. First subpixel groups and second subpixel groups are disposed alternately along the Y-axis. A first subpixel group consists of two adjacent green subpixel pairs and a red subpixel and a blue subpixel sandwiched between the green subpixel pairs. A second subpixel group consists of one green subpixel pair and a red subpixel and a blue subpixel adjacent to (sandwiching) the green subpixel pair.

Each of the red subpixels 601 to 604, the blue subpixels 641 to 644, and the green subpixels 615 to 618 in the middle column is lighted at a predetermined luminance to display white. The green subpixels 611 to 614 in the left column and the green subpixels 619 to 622 in the right column are lighted at luminance lower than the green subpixels 615 to 618 in the middle column. The green subpixels 611, 613, 620, and 622 are lighted at the same luminance. The green subpixels 612, 614, 619, and 621 are lighted at the same luminance but lower than the luminance of the green subpixels 611, 613, 620, and 622. This configuration achieves the uniform thickness of the white line. The luminance of the green subpixels 612, 614, 619, and 621 can be 0.

Compared to the comparative example in FIG. 8, the X-coordinates of the green subpixels in the subpixel layout in this embodiment are dispersed to achieve high resolution along the X-axis. In the comparative example in FIG. 8, the centroids of the green subpixels in the same green subpixel column have the same X-coordinate. In the subpixel layout in this embodiment in FIG. 9, the centroids of the green subpixels constituting a green subpixel pair have different X-coordinates.

For example, all the centroids of the green subpixels 612, 611, 615, 616, 620, and 619 have different X-coordinates. The X-coordinates of the centroids of the green subpixels 611, 613, 620, and 622 are closer to the X-coordinate of the green subpixel pair in the middle column and the X-coordinates of the centroids of the green subpixels 612, 614, 619, and 621 are farther from the X-coordinate of the green subpixel pair in the middle column. That is to say, the distances along the X-axis from the centroids of the green subpixels 611, 613, 620, and 622 to the centroids of the green subpixel pairs in the middle column are shorter than the distances along the X-axis from the centroids of the green subpixels 612, 614, 619, and 621 to the centroids of the green subpixel pairs in the middle column.

The driver IC 134 uses a subpixel rendering technique to light the green subpixels 611, 613, 620, and 622 in the columns on both sides that are closer to the green subpixels in the middle column at higher luminance and light the green subpixels 612, 614, 619, and 621 in the columns on both sides that are farther from the green subpixels in the middle column at lower luminance (which can be zero), as described above.

The driver IC 134 receives a picture signal and a picture signal timing signal from a not-shown main controller. The picture signal includes data (signal) for successive picture frames. The driver IC 134 determines driving signal values (luminance values) for the subpixels from the data on the pixels in each picture frame (data or information on one pixel includes information on three colors) using a subpixel rendering technique. The subpixel rendering technique determines the luminance of one subpixel from the data on one or more pixels in a picture frame.

The driver IC 134 sends a display control driving signal generated from the picture signal timing signal to the scanning driver 131 and the emission driver 132 and outputs a driving signal for the subpixels to the pixel circuits in the display region 125.

As described above, the subpixel layout in this embodiment achieves high resolution along the X-axis. The driver IC 134 can finely adjust the line width LW of the white line by adjusting the luminance of the green subpixels.

Figure 10:
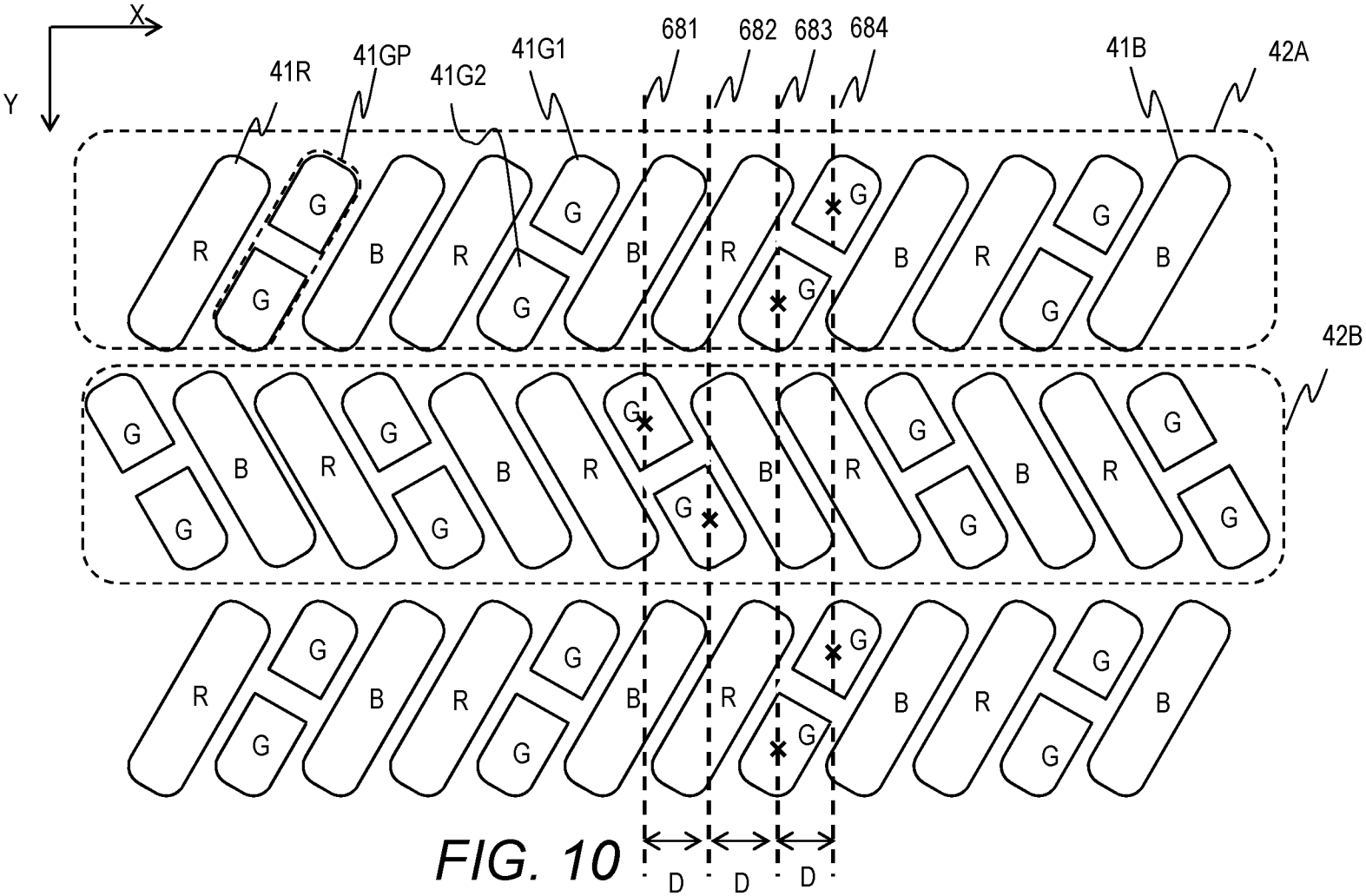
FIG. 10 illustrates another example of a subpixel layout.

FIG. 10 illustrates another example of a subpixel layout. The subpixel layout in FIG. 10 is composed of subpixels having a large tilt angle with respect to the Y-axis (in the example of FIG. 10, 30°), compared to the subpixel layout in FIG. 5. The lines 681 to 684 extending along the Y-axis in FIG. 10 are consecutive virtual lines passing through the centroids of green subpixels. In the subpixel layout in FIG. 10, the intervals D between lines adjacent to each other in the lines 681 to 684 are equal. As noted from this example, the X-coordinates of green subpixels are spaced evenly to achieve more uniform luminance distribution in the X-direction.

Figure 11:
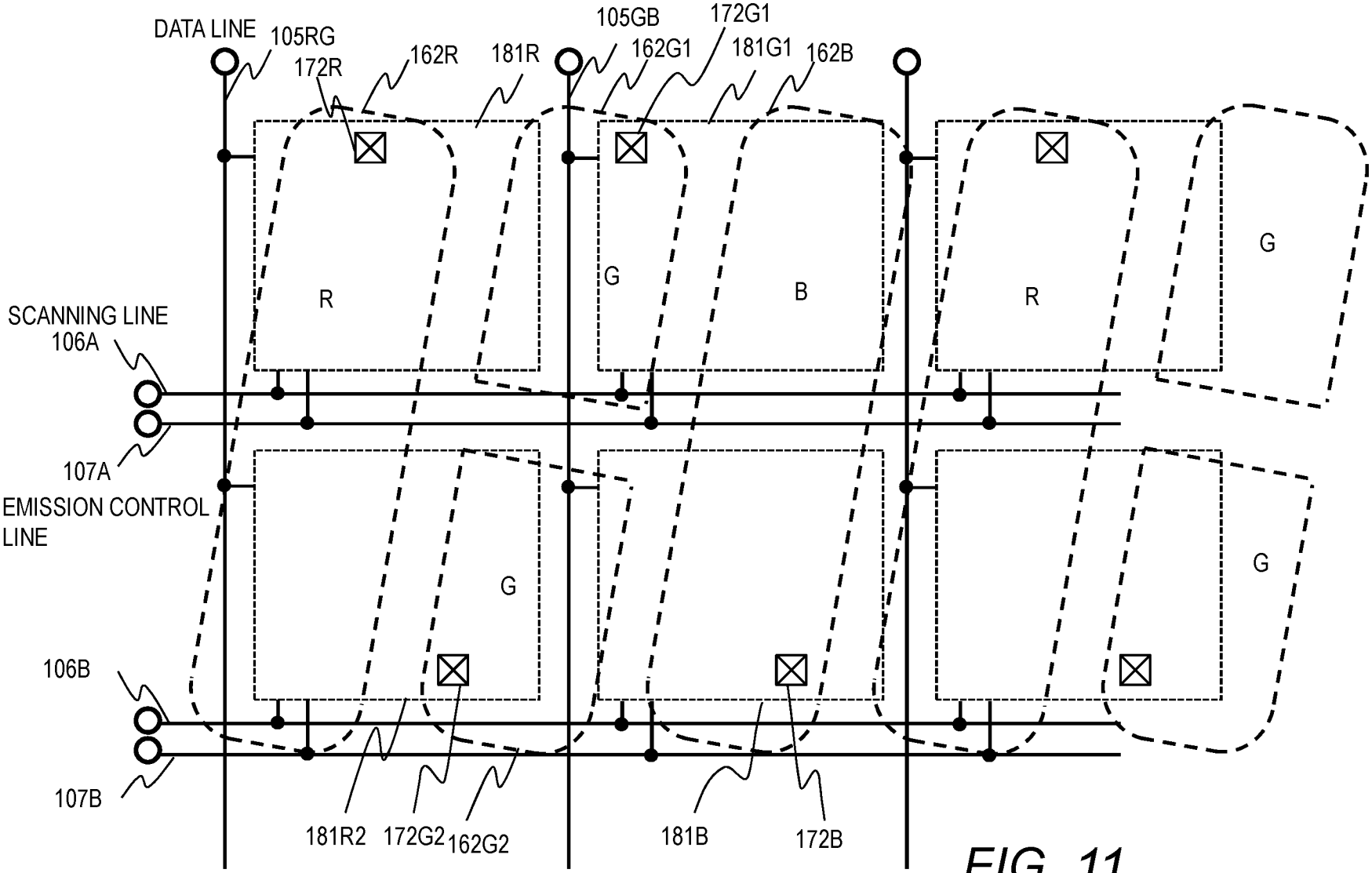
FIG. 11 schematically illustrates a locational relation among pixel circuits, lines, and anode electrodes in a display region.

FIG. 11 schematically illustrates a locational relation among pixel circuits, lines, and anode electrodes in the display region 125. In FIG. 11, only some of the components are provided with reference signs for convenience of illustration.

The anode electrode 162R of a red subpixel is connected with a pixel circuit 181R via a through-hole 172R. The anode electrode 162G1 of one green subpixel of a green subpixel pair is connected with a pixel circuit 181G1 via a through-hole 172G1. The anode electrode 162G2 of the other green subpixel of a green subpixel pair is connected with a pixel circuit 181G2 via a through-hole 172G2. The anode electrode 162B of a blue subpixel is connected with a pixel circuit 181B via a through-hole 172B. The circuit configuration of a subpixel in this example has a top-emission structure; the anode electrodes can be fabricated and disposed flexibly upper than the pixel circuit.

Figure 12:
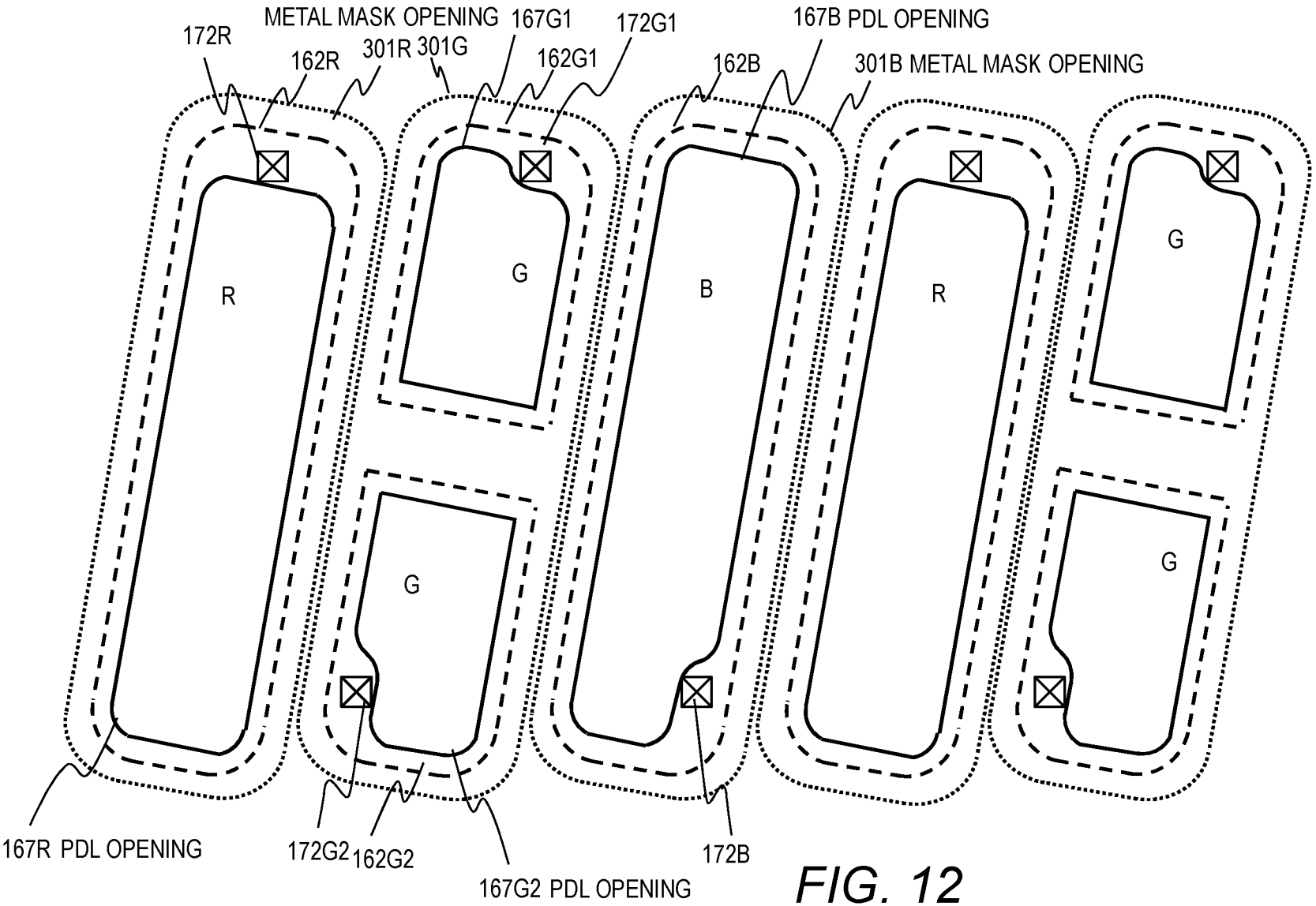
FIG. 12 schematically illustrates a locational relation among anode electrodes, PDL openings, and openings of metal masks to be used for vapor deposition of organic EL material.

FIG. 12 schematically illustrates a locational relation among anode electrodes, PDL openings, and openings of metal masks to be used for vapor deposition of organic EL material. In FIG. 12, only some of the components are provided with reference signs for convenience of illustration. Different metal masks are prepared for individual colors. Each metal mask has a plurality of openings and each opening corresponds to a subpixel or a subpixel pair of the specific color. Since the subpixel layout in this embodiment is a delta-nabla layout, each metal mask can have a large distance between openings relative to the size of an opening.

As illustrated in FIG. 12, an opening 301R of the metal mask for red subpixels encloses the anode electrode 162R and the PDL opening 167R of a red subpixel in a planar view. The perimeter of the anode electrode 162R encloses the PDL opening 167R in a planar view. In the configuration example in FIG. 12, a contact hole 172R is located outside the PDL opening 167R.

An opening 301G of the metal mask for green subpixels encloses the anode electrodes 162G1 and 162G2 and the PDL openings 167G1 and 167G2 of two green subpixels constituting a green subpixel pair. The perimeter of the anode electrode 162G1 encloses the PDL opening 167G1 and the perimeter of the anode electrode 162G2 encloses the PDL opening 167G2. In the configuration example in FIG. 12, contact holes 172G1 and 172G2 are located outside the PDL openings 167G1 and 167G2.

An opening 301B of the metal mask for blue subpixels encloses the anode electrode 162B and the PDL opening 167B of a blue subpixel in a planar view. The perimeter of the anode electrode 162B encloses the PDL opening 167B in a planar view. In the configuration example in FIG. 12, a contact hole 172B is located outside the PDL opening 167B.

Hereinafter, a method for the driver IC 134 to determine driving signal values (luminance values) for the subpixels from data on pixels (frame pixels) in a picture frame is described. The data (information) on one pixel includes information on three colors.

Figure 13:
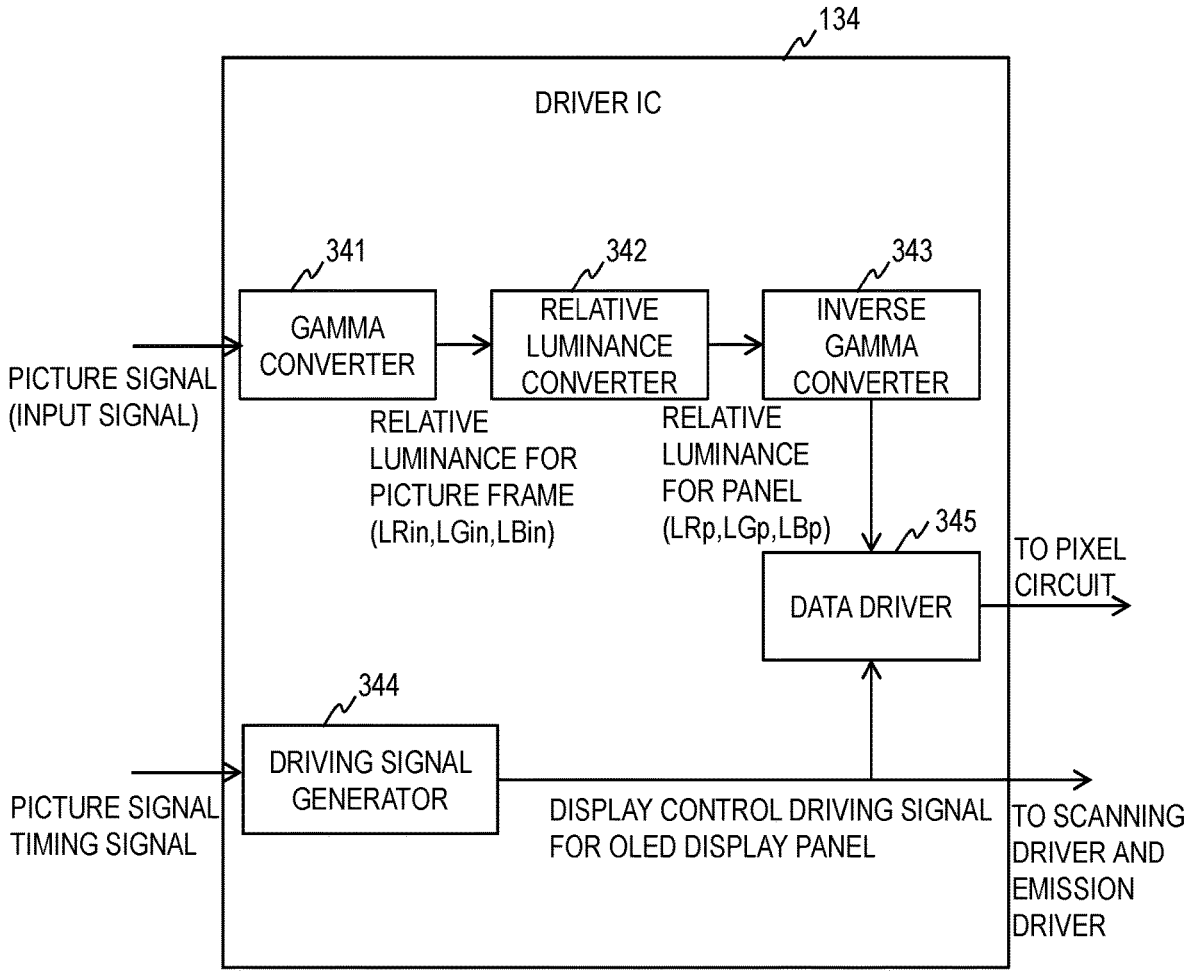
FIG. 13 illustrates logical elements of a driver IC.

FIG. 13 illustrates logical elements of the driver IC 134. The driver IC 134 includes a gamma converter 341, a relative luminance converter 342, an inverse gamma converter 343, a driving signal generator 344, and a data driver 345.

The driver IC 134 receives a picture signal and a picture signal timing signal from a not-shown main controller. The picture signal includes data (signal) for successive picture frames. The gamma converter 341 converts the RGB scale values (signal) included in the input picture signal to RGB relative luminance values. More specifically, the gamma converter 341 converts the R scale values, the G scale values, and the B scale values for individual pixels of each picture frame into R relative luminance values (LRin), G relative luminance values (LGin), and B relative luminance values (LBin). The relative luminance values for a frame pixel are luminance values normalized in the picture frame.

The relative luminance converter 342 converts the R, G, B relative luminance values (LRin, LGin, LBin) for individual pixels of a picture frame into R, G, B relative luminance values (LRp, LGp, LBp) for subpixels of the OLED display panel. The details of the arithmetic processing of the relative luminance converter 342 will be described later. The relative luminance value for a subpixel is a luminance value for the subpixel normalized in the OLED display panel.

The inverse gamma converter 343 converts the relative luminance values for the R subpixels, G subpixels, and B subpixels calculated by the relative luminance converter 342 to scale values for the R subpixels, G subpixels, and B subpixels. The data driver 345 sends a driving signal in accordance with the scale values for the R subpixels, G subpixels, and B subpixels to the pixel circuits.

The driving signal generator 344 converts an input picture signal timing signal to a display control driving signal for the OLED display panel. The picture signal timing signal includes a dot clock (pixel clock) for determining the data transfer rate, a horizontal synchronization signal, a vertical synchronization signal, and a data enable signal.

The driving signal generator 344 converts the frequency of the dot clock of the input picture signal timing signal in accordance with the number of pixels in the delta-nabla panel (OLED display panel). The driving signal generator 344 further generates control signals for the data driver 345, the scanning driver 131, and the emission driver 132 of the delta-nabla panel (or the driving signal for the panel) from the data enable signal, the vertical synchronization signal, and the horizontal synchronization signal and outputs the signals to the drivers.

Figure 14:
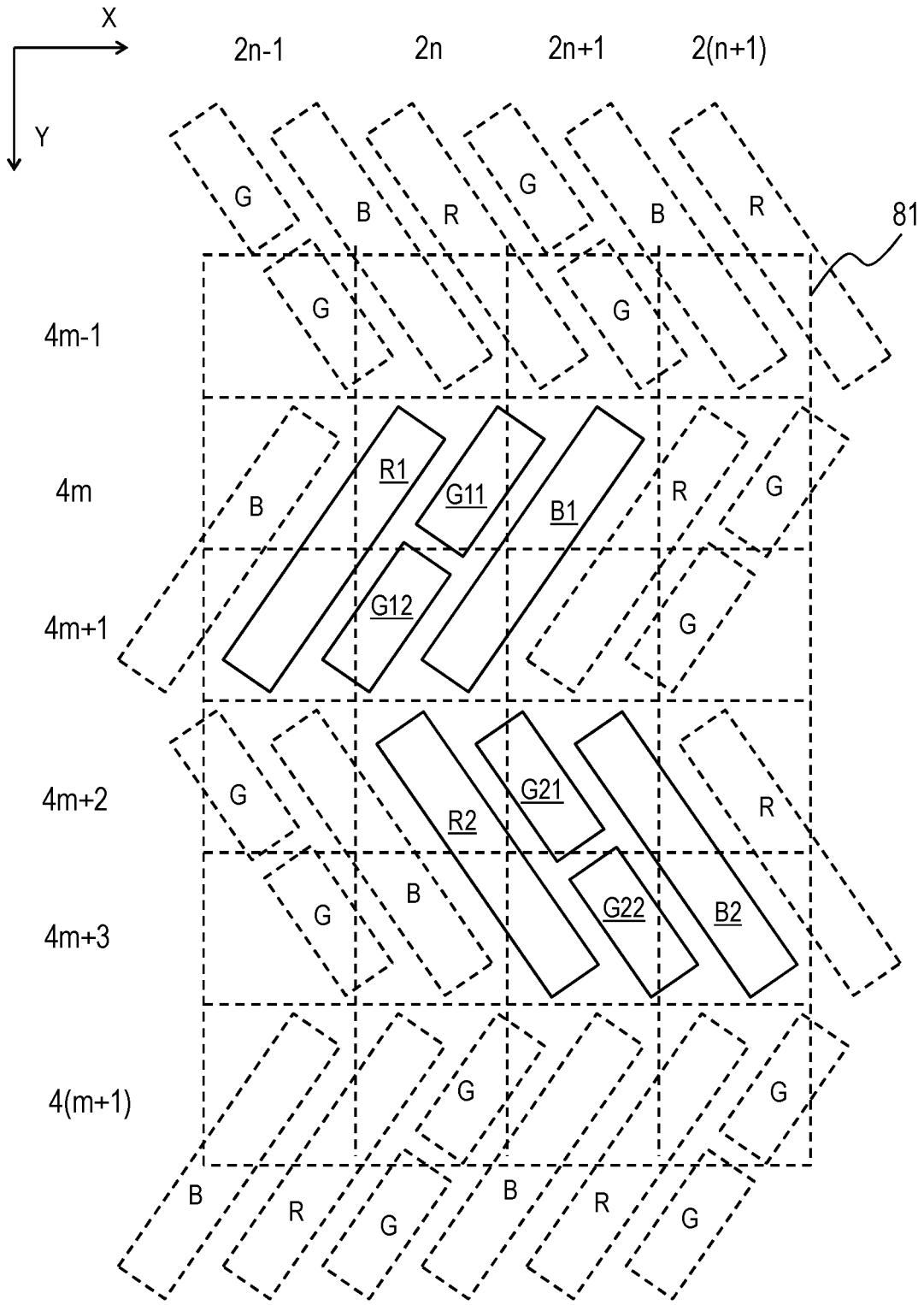
FIG. 14 illustrates a relation between a frame pixel set in a part of a picture frame and a part of the subpixels of an OLED display panel.

FIG. 14 illustrates a relation between a frame pixel set 81 in a part of a picture frame and a part of the subpixels of an OLED display panel. The image displayed in a picture frame is composed of frame pixels disposed in the row direction (the direction along the X-axis) and the column direction (the direction along the Y-axis) like a matrix. The frame pixels in FIG. 14 have the identical shapes and they are represented by squares in broken lines. The pitch of the frame pixels along the X-axis is ⅔ of the pitch of the subpixels along the X-axis. The pitch of the frame pixels along the Y-axis is twice the pitch of subpixels or subpixel pairs (subpixel rows) along the Y-axis.

FIG. 14 shows frame pixels having X-coordinates of 2n−1 to 2(n+1) and Y-coordinates of 4m−1 to 4(m+1), where n and m can be natural numbers. Hereinafter, a frame pixel row composed of frame pixels disposed along the X-axis is identified by an X-coordinate and a frame pixel column composed of frame pixels disposed along the Y-axis is identified by a Y-coordinate. Further, a frame pixel is identified by (X-coordinate, Y-coordinate). For example, the frame pixel on the upper-left corner in FIG. 14 is referred to as frame pixel (2n−1, 4m−1). The frame pixel column and the frame pixel row are both referred to as frame pixel line.

In FIG. 14, each subpixel is schematically represented by a rectangle in a broken or solid line. As described above, the shape of each subpixel is not limited to a rectangle. The letter R, G, or B in each rectangle representing a subpixel means the color red, green, or blue, respectively, of the subpixel.

The subpixels R1 and R2 in solid lines are red subpixels. The subpixels B1, and B2 in solid lines are blue subpixels. The subpixels G11, G12, G21, and G22 in solid lines are green subpixels. The green subpixels G11 and G12 constitute one green subpixel pair and the green subpixels G21 and G22 constitute another green subpixel pair.

The subpixels R1, G11, G12, and B1 are subpixels and a subpixel pair adjacent to one another in the same subpixel row. The subpixels R2, G21, G22, and B2 are subpixels and a subpixel pair adjacent to one another in the same subpixel row adjacent to the foregoing subpixel row. Between two subpixel rows adjacent to each other, the directions in which the subpixels or the subpixel pair are tilted with respect to the X-axis are opposite.

In the following, determining the relative luminance values for the subpixels R1, R2, B1, B2, G11, G12, G21, and G22 indicated by solid lines are described. The following example uses relative luminance values directly indicating the relative luminance of the subpixels and frame pixels; however, any numerical values representing relative luminance can be used, if relative luminance for each subpixel can be determined from relative luminance of each frame pixel.

Each subpixel is assigned a plurality of frame pixels having a specific locational relation and the relative luminance value for the subpixel is calculated by the product sum of the relative luminance values of the assigned frame pixels. The subpixels R1, R2, B1, B2, G11, G12, G21, and G22 constitute a unit in the display region. This unit is disposed repeatedly in a plane to be a display region. Accordingly, the relative luminance value for a given subpixel can be determined in the same way as the relative luminance value for one of the subpixels of the same color in these eight subpixels.

In displaying a white line of one frame pixel column, the luminance values (relative luminance values) of the outer green subpixels in the green subpixel pairs on both sides of the white line are lower than the luminance values of the inner green subpixels, as described with reference to FIG. 9. First, a method of determining the relative luminance values for individual subpixels in an OLED display device in the case where the luminance values of the outer green subpixels are to be zero.

Figure 15:
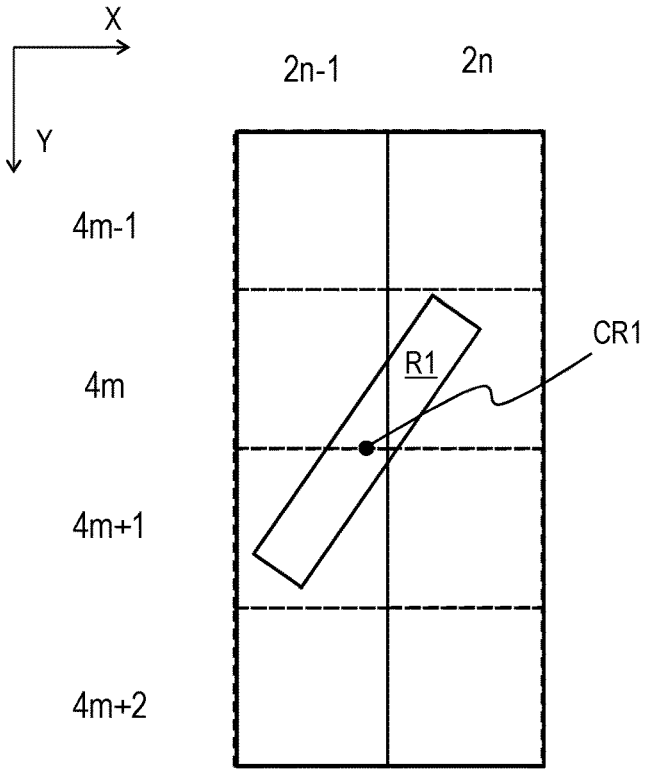
FIG. 15 illustrates a red subpixel and the frame pixels to assign their relative luminance values to the subpixel.

FIG. 15 illustrates the red subpixel R1 and the frame pixels to assign their relative luminance values to the subpixel R1. The subpixel R1 is assigned the relative luminance values of four consecutive frame pixels (2n−1, 4m−1), (2n−1, 4m), (2n−1, 4m+1), and (2n−1, 4m+2) in the frame pixel column (2n−1). Further, the subpixel R1 is assigned the relative luminance values of four consecutive frame pixels (2n, 4m−1), (2n, 4m), (2n, 4m+1), and (2n, 4m+2) in the frame pixel column (2n).

The relative luminance value LR1 of the subpixel R1 can be expressed as the following formula:

$$LR1=LR\text{in}(2n-1,4m-1)*(3/24)+LR\text{in}(2n,4m-1)*(1/24)+LR\text{in}(2n-1,4m)*(5/24)+LR\text{in}(2n,4m)*(3/24)+LR\text{in}(2n-1,4m+1)*(5/24)+LR\text{in}(2n,4m+1)*(3/24)+LR\text{in}(2n-1,4m+2)*(3/24)+LR\text{in}(2n,4m+2)*(1/24),$$

where LRin(x, y) represents the red relative luminance value of a frame pixel at coordinates (x, y).

In the example of FIG. 15, the centroid CR1 of the subpixel R1 is included in the frame pixel column (2n−1) and on the boundary between the frame pixel row (4m) and the frame pixel row (4m+1). The centroid CR1 is closer to the frame pixel column (2n) than the centerline along the Y-axis of the frame pixel column (2n−1).

The frame pixel columns (2−n) and (2n) are two frame pixel columns that are closest in distance from the centroid CR1 of the subpixel R1. The distance between the centroid of a subpixel and a frame pixel column can be the distance between the centroid of the subpixel and the line passing through the centroids of the frame pixels in the frame pixel column (the centerline along the Y-axis of the frame pixel column).

The frame pixels (2n−1, 4m−1), (2n−1, 4m), (2n−1, 4m+1), and (2n−1, 4m+2) are four frame pixels closest to the subpixel R1 in the frame pixel column (2n−1). The distance between a frame pixel and a subpixel can be the distance between their centroids.

The frame pixels (2n, 4m−1), (2n, 4m), (2n, 4m+1), and (2n, 4m+2) are four frame pixels closest to the subpixel R1 in the frame pixel column (2n). The foregoing eight frame pixels are eight frame pixels closest to the subpixel R1 in the frame pixel columns (2n−1) and (2n).

According to the foregoing formula, the weights to the frame pixels (2n−1, 4m) and (2n−1, 4m+1) closest to the red subpixel R1 (the centroid thereof) are the highest and the weights to the farthest frame pixels (2n, 4m−1) and (2n, 4m+2) are the lowest. The weights to the other frame pixels (2n−1, 4m−1), (2n−1, 4m+2), (2n, 4m), and (2n, 4m+1) are the same value between the lowest value and the highest value.

Figure 16:
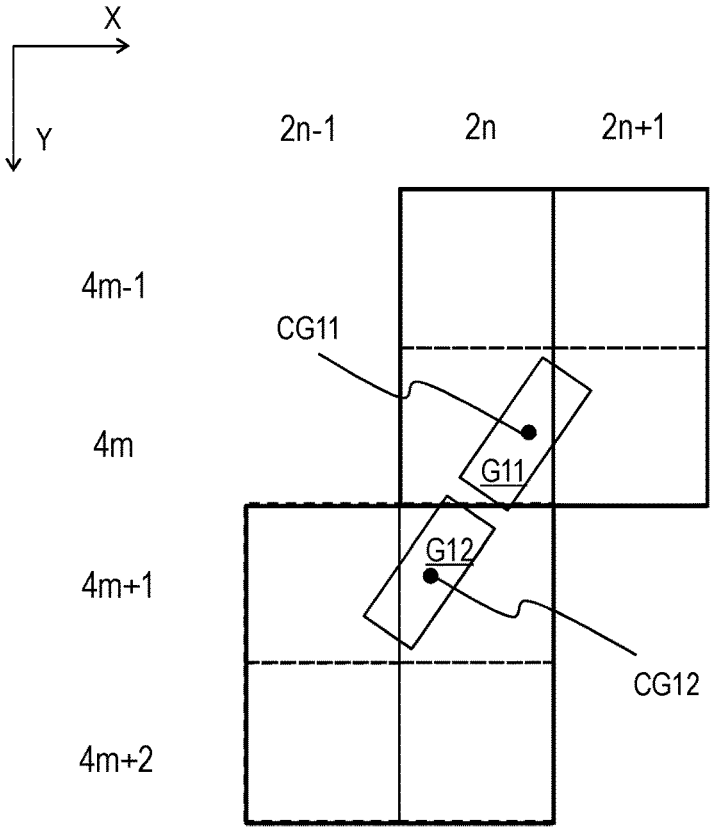
FIG. 16 illustrates green subpixels and the frame pixels to assign their relative luminance values to the subpixels.

FIG. 16 illustrates the green subpixels G11 and G12 and the frame pixels to assign their relative luminance values to the subpixels G11 and G12. The subpixel G11 is assigned the relative luminance values of two adjacent frame pixels (2n, 4m−1) and (2n+1, 4m−1) in the frame pixel row (4m−1.) Further, the subpixel G11 is assigned the relative luminance values of two adjacent frame pixels (2n, 4m) and (2n+1, 4m) in the frame pixel row (4m).

The relative luminance value LG11 of the subpixel G11 can be expressed as the following formula:

$$LG11=LG\text{in}(2n,4m-1)*(3/12)+LG\text{in}(2n+1,4m-1)*(1/12)+LG\text{in}(2n,4m)*(5/12)+LG\text{in}(2n+1,4m)*(3/12),$$

where LGin(x, y) represents the green relative luminance value of a frame pixel at coordinates (x, y).

In the example of FIG. 16, the centroid CG11 of the subpixel G11 is included in the frame pixel row (4m) and the frame pixel column (2n), namely, the frame pixel (2n, 4m). The centroid CG11 is closer to the frame pixel column (2n+1) than the centerline along the Y-axis of the frame pixel column (2n).

The frame pixel row (4m) is the frame pixel row that is closest from the centroid CG11 of the subpixel G11. The distance between the centroid of a subpixel and a frame pixel row can be the distance between the centroid of the subpixel and the line passing through the centroids of the frame pixels in the frame pixel row (the centerline along the X-axis of the frame pixel row). The frame pixels (2n, 4m) and (2n+1, 4m) are two frame pixels closest to the centroid CG11 of the subpixel G11 in the frame pixel row (4m).

The frame pixel row (4m−1) is adjacent to the frame pixel row (4m) on the opposite side of the subpixel G12. The frame pixels (2n, 4m−1) and (2n+1, 4m−1) are two frame pixels closest to the centroid CG11 of the subpixel G11 in the frame pixel row (4m−1).

According to the foregoing formula, the weight to the frame pixel (2n, 4m) closest to the green subpixel G11 (the centroid thereof) is the highest and the weight to the farthest frame pixel (2n+1, 4m−1) is the lowest. The weights to the other two frame pixels (2n, 4m−1) and (2n+1, 4m) are the same value between the lowest value and the highest value.

The subpixel G12 is assigned the relative luminance values of two adjacent frame pixels (2n−1, 4m+1) and (2n, 4m+1) in the frame pixel row (4m+1). Further, the subpixel G12 is assigned the relative luminance values of two adjacent frame pixels (2n−1, 4m+2) and (2n, 4m+2) in the frame pixel row (4m+2).

The relative luminance value LG12 of the subpixel G12 can be expressed as the following formula:

$$LG12=LG\text{in}(2n-1,4m+1)*(3/12)+LG\text{in}(2n,4m+1)*(5/12)+LG\text{in}(2n-1,4m+2)*(1/12)+LG\text{in}(2n,4m+2)*(3/12).$$

In the example of FIG. 16, the centroid CG12 of the subpixel G12 is included in the frame pixel row (4m+1) and the frame pixel column (2n), namely, the frame pixel (2n, 4m+1). The centroid CG12 is closer to the frame pixel column (2n−1) than the centerline along the Y-axis of the frame pixel column (2n).

The frame pixel row (4m+1) is the frame pixel row that is closest from the centroid CG12 of the subpixel G12. The frame pixels (2n−1, 4m+1) and (2n, 4m+1) are two frame pixels closest to the centroid CG12 of the subpixel G12 in the frame pixel row (4m+1).

The frame pixel row (4m+2) is adjacent to the frame pixel row (4m+1) on the opposite side of the subpixel G11. The frame pixels (2n−1, 4m+2) and (2n, 4m+2) are two frame pixels closest to the centroid CG12 of the subpixel G12 in the frame pixel row (4m+2).

According to the foregoing formula, the weight to the frame pixel (2n, 4m+1) closest to the green subpixel G12 (the centroid thereof) is the highest and the weight to the farthest frame pixel (2n−1, 4m+2) is the lowest. The weights to the other two frame pixels (2n−1, 4m+1) and (2n, 4m+2) are the same value between the lowest value and the highest value.

Figure 17:
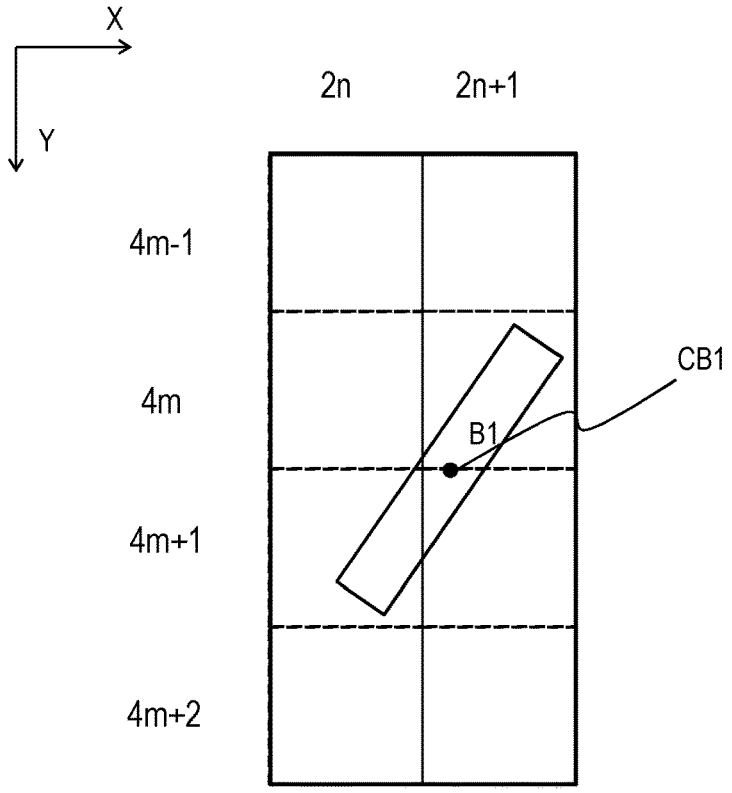
FIG. 17 illustrates a blue subpixel and the frame pixels to assign their relative luminance values to the subpixel.

FIG. 17 illustrates the blue subpixel B1 and the frame pixels to assign their relative luminance values to the subpixel B1. The subpixel B1 is assigned the relative luminance values of four consecutive frame pixels (2n, 4m−1), (2n, 4m), (2n, 4m+1), and (2n, 4m+2) in the frame pixel column (2n).

Further, the subpixel B1 is assigned the relative luminance values of four consecutive frame pixels (2n+1, 4m−1), (2n+1, 4m), (2n+1, 4m+1), and (2n+1, 4m+2) in the frame pixel column (2n+1).

The relative luminance value LB1 of the subpixel B1 can be expressed as the following formula:

$$LB1=LB\text{in}(2n,4m-1)*(1/24)+LB\text{in}(2n+1,4m-1)*(3/24)+LB\text{in}(2n,4m)*(3/24)+LB\text{in}(2n+1,4m)*(5/24)+LB\text{in}(2n,4m+1)*(3/24)+LB\text{in}(2n+1,4m+1)*(5/24)+LB\text{in}(2n,4m+2)*(1/24)+LB\text{in}(2n+1,4m+2)*(3/24),$$

where LBin(x, y) represents the blue relative luminance value of a frame pixel at coordinates (x, y).

In the example of FIG. 17, the centroid CB1 of the subpixel B1 is included in the frame pixel column (2n+1) and on the boundary between the frame pixel row (4m) and the frame pixel row (4m+1). The centroid CB1 is closer to the frame pixel column (2n) than the centerline along the Y-axis of the frame pixel column (2n+1).

The frame pixel columns (2n) and (2n+1) are two frame pixel columns that are closest in distance from the centroid CB1 of the subpixel B1. The frame pixels (2n, 4m−1), (2n, 4m), (2n, 4m+1), and (2n, 4m+2) are four frame pixels closest to the subpixel B1 in the frame pixel column (2n). The frame pixels (2n+1, 4m−1), (2n+1, 4m), (2n+1, 4m+1), and (2n+1, 4m+2) are four frame pixels closest to the subpixel B1 in the frame pixel column (2n+1). The foregoing eight frame pixels are eight frame pixels closest to the subpixel B1 in the frame pixel columns (2n) and (2n+1).

According to the foregoing formula, the weights to the frame pixels (2n+1, 4m) and (2n+1, 4m+1) closest to the subpixel B1 (the centroid thereof) are the highest and the weights to the farthest frame pixels (2n, 4m−1) and (2n, 4m+2) are the lowest. The weights to the other frame pixels (2n, 4m), (2n, 4m+1), (2n+1, 4m−1), and (2n+1, 4m+2) are the same value between the lowest value and the highest value.

Figure 18:
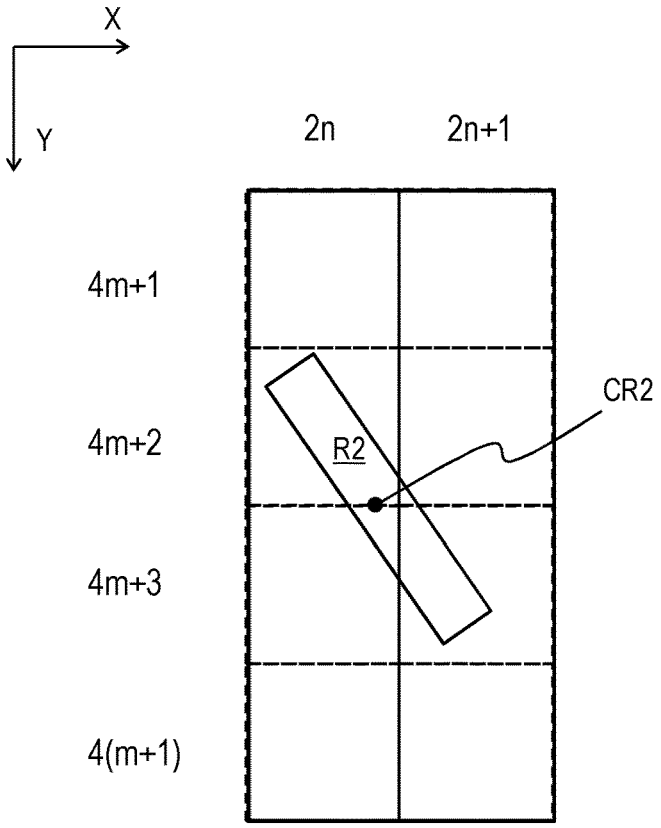
FIG. 18 illustrates another red subpixel and the frame pixels to assign their relative luminance values to the subpixel.

FIG. 18 illustrates the red subpixel R2 and the frame pixels to assign their relative luminance values to the subpixel R2. The subpixel R2 is assigned the relative luminance values of four consecutive frame pixels (2n, 4m+1), (2n, 4m+2), (2n, 4m+3), and (2n, 4(m+1)) in the frame pixel column (2n). Further, the subpixel R2 is assigned the relative luminance values of four consecutive frame pixels (2n+1, 4m+1), (2n+1, 4m+2), (2n+1, 4m+3), and (2n+1, 4(m+1)) in the frame pixel column (2n+1).

The relative luminance value LR2 of the subpixel R2 can be expressed as the following formula:

$$LR2=LR\text{in}(2n,4m+1)*(3/24)+LR\text{in}(2n+1,4m+1)*(1/24)+LR\text{in}(2n,4m+2)*(5/24)+LR\text{in}(2n+1,4m+2)*(3/24)+LR\text{in}(2n,4m+3)*(5/24)+LR\text{in}(2n+1,4m+3)*(3/24)+LR\text{in}(2n,4(m+1))*(3/24)+LR\text{in}(2n+1,4(m+1))*(1/24).$$

In the example of FIG. 18, the centroid CR2 of the subpixel R2 is included in the frame pixel column (2n) and on the boundary between the frame pixel row (4m+2) and the frame pixel row (4m+3). The centroid CR2 is closer to the frame pixel column (2n+1) than the centerline along the Y-axis of the frame pixel column (2n).

The frame pixel columns (2n) and (2n+1) are two frame pixel columns that are closest in distance from the centroid CR2 of the subpixel R2. The frame pixels (2n, 4m+1), (2n, 4m+2), (2n, 4m+3), and (2n, 4(m+1)) are four frame pixels closest to the subpixel R2 in the frame pixel column (2n).

The frame pixels (2n+1, 4m+1), (2n+1, 4m+2), (2n+1, 4m+3), and (2n+1, 4(m+1)) are four frame pixels closest to the subpixel R2 in the frame pixel column (2n+1). The foregoing eight frame pixels are eight frame pixels closest to the subpixel R2 in the frame pixel columns (2n) and (2n+1).

According to the foregoing formula, the weights to the frame pixels (2n, 4m+2) and (2n, 4m+3) closest to the red subpixel R2 (the centroid thereof) are the highest and the weights to the farthest frame pixels (2n+1, 4m+1) and (2n+1, 4(m+1)) are the lowest. The weights to the other frame pixels (2n, 4m+1), (2n, 4(m+1)), (2n+1, 4m+2), and (2n+1, 4m+3) are the same value between the lowest value and the highest value.

Figure 19:
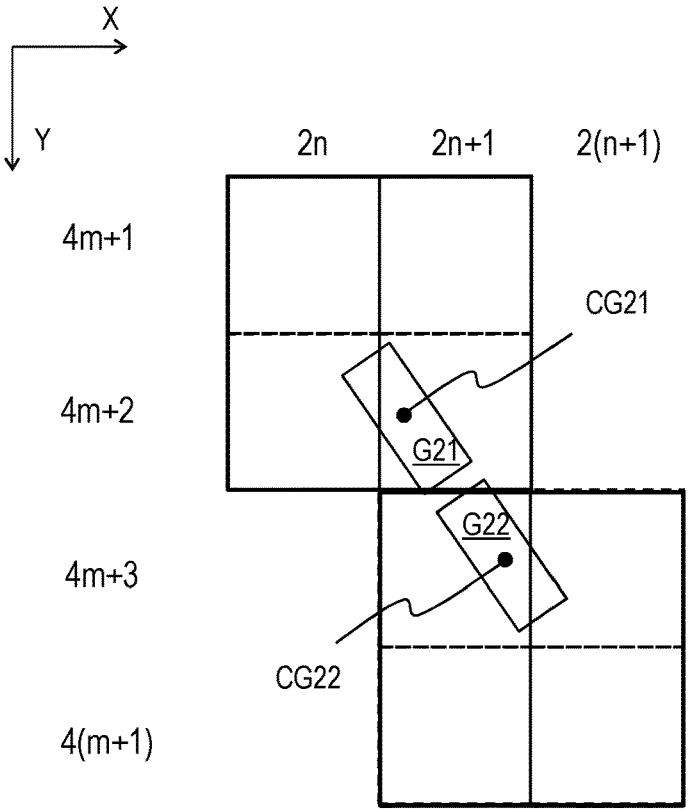
FIG. 19 illustrates other green subpixels and the frame pixels to assign their relative luminance values to the subpixels.

FIG. 19 illustrates the green subpixels G21 and G22 and the frame pixels to assign their relative luminance values to the subpixels G21 and G22.

The subpixel G21 is assigned the relative luminance values of two adjacent frame pixels (2n, 4m+1) and (2n+1, 4m+1) in the frame pixel row (4m+1). Further, the subpixel G21 is assigned the relative luminance values of two adjacent frame pixels (2n, 4m+2) and (2n+1, 4m+2) in the frame pixel row (4m+2).

The relative luminance value LG21 of the subpixel G21 can be expressed as the following formula:

$$LG21=LG\text{in}(2n,4m+1)*(1/12)+LG\text{in}(2n+1,4m+1)*(3/12)+LG\text{in}(2n,4m+2)*(3/12)+LG\text{in}(2n+1,4m+2)*(5/12).$$

In the example of FIG. 19, the centroid CG21 of the subpixel G21 is included in the frame pixel row (4m+2) and the frame pixel column (2n+1), namely, the frame pixel (2n+1, 4m+2). The centroid CG21 is closer to the frame pixel column (2n) than the centerline along the Y-axis of the frame pixel column (2n+1).

The frame pixel row (4m+2) is the frame pixel row that is closest from the centroid CG21 of the subpixel G21. The frame pixels (2n, 4m+2) and (2n+1, 4m+2) are two frame pixels closest to the centroid CG21 of the subpixel G21 in the frame pixel row (4m+2).

The frame pixel row (4m+1) is adjacent to the frame pixel row (4m+2) on the opposite side of the subpixel G22. The frame pixels (2n, 4m+1) and (2n+1, 4m+1) are two frame pixels closest to the centroid CG21 of the subpixel G21 in the frame pixel row (4m+1).

According to the foregoing formula, the weight to the frame pixel (2n+1, 4m+2) closest to the green subpixel G21 (the centroid thereof) is the highest and the weight to the farthest frame pixel (2n, 4m+1) is the lowest. The weights to the other two frame pixels (2n+1, 4m+1) and (2n, 4m+2) are the same value between the lowest value and the highest value.

The subpixel G22 is assigned the relative luminance values of two adjacent frame pixels (2n+1, 4m+3) and (2(n+1), 4m+3) in the frame pixel row (4m+3). Further, the subpixel G22 is assigned the relative luminance values of two adjacent frame pixels (2n+1, 4(m+1)) and (2(n+1), 4(m+1)) in the frame pixel row (4(m+1)).

The relative luminance value LG22 of the subpixel G22 can be expressed as the following formula:

$$LG22=LG\text{in}(2n+1,4m+3)*(5/12)+LG\text{in}(2(n+1),4m+3)*(3/12)+LG\text{in}(2n+1,4(m+1))*(3/12)+LG\text{in}(2(n+1),4(m+1))*(1/12).$$

In the example of FIG. 19, the centroid CG22 of the subpixel G22 is included in the frame pixel row (4m+3) and the frame pixel column (2n+1), namely, the frame pixel (2n+1, 4m+3). The centroid CG22 is closer to the frame pixel column (2(n+1)) than the centerline along the Y-axis of the frame pixel column (2n+1).

The frame pixel row (4m+3) is the frame pixel row that is closest from the centroid CG22 of the subpixel G22. The frame pixels (2n+1, 4m+3) and (2(n+1), 4m+3) are two frame pixels closest to the centroid CG22 of the subpixel G22 in the frame pixel row (4m+3).

The frame pixel row (4(m+1)) is adjacent to the frame pixel row (4m+3) on the opposite side of the subpixel G21. The frame pixels (2n+1, 4(m+1)) and (2(n+1), 4(m+1)) are two frame pixels closest to the centroid CG22 of the subpixel G22 in the frame pixel row (4(m+1)).

According to the foregoing formula, the weight to the frame pixel (2n+1, 4m+3) closest to the green subpixel G22 (the centroid thereof) is the highest and the weight to the farthest frame pixel (2(n+1), 4(m+1)) is the lowest. The weights to the other two frame pixels (2(n+1), 4m+3) and (2n+1, 4(m+1)) are the same value between the lowest value and the highest value.

Figure 20:
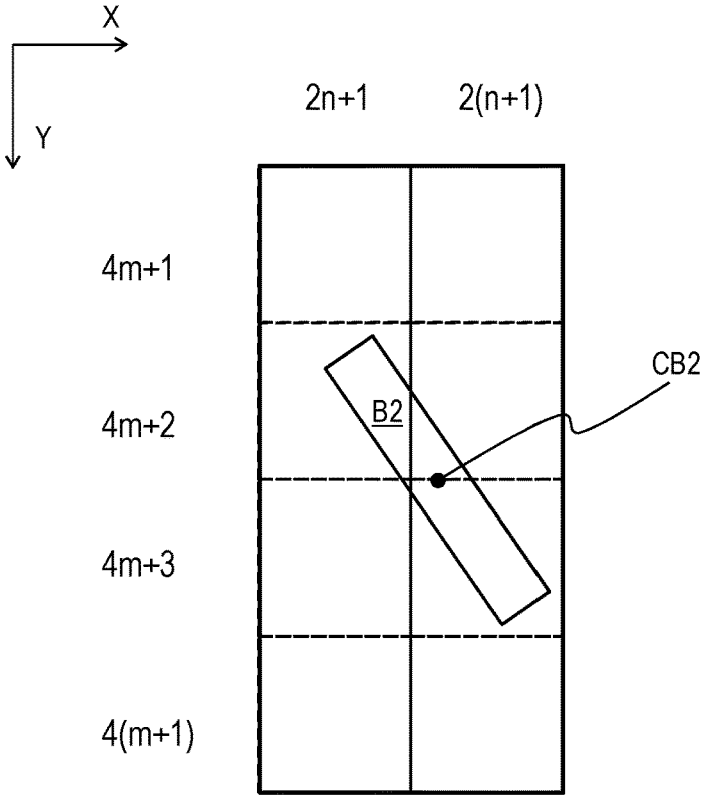
FIG. 20 illustrates another blue subpixel and the frame pixels to assign their relative luminance values to the subpixel.

FIG. 20 illustrates the blue subpixel B2 and the frame pixels to assign their relative luminance values to the subpixel B2. The subpixel B2 is assigned the relative luminance values of four consecutive frame pixels (2n+1, 4m+1), (2n+1, 4m+2), (2n+1, 4m+3), and (2n+1, 4(m+1)) in the frame pixel column (2n+1). Further, the subpixel B2 is assigned the relative luminance values of four consecutive frame pixels (2(n+1), 4m+1), (2(n+1), 4m+2), (2(n+1), 4m+3), and (2(n+1), 4(m+1)) in the frame pixel column (2(n+1)).

The relative luminance value LB2 of the subpixel B2 can be expressed as the following formula:

$$LB2=LB\text{in}(2n+1,4m+1)*(1/24)+LB\text{in}(2(n+1),4m+1)*(3/24)+LB\text{in}(2n+1,4m+2)*(3/24)+LB\text{in}(2(n+1),4m+2)*(5/24)+LB\text{in}(2n+1,4m+3)*(3/24)+LB\text{in}(2(n+1),4m+3)*(5/24)+LB\text{in}(2n+1,4(m+1))*(1/24)+LB\text{in}(2(n+1),4(m+1))*(3/24).$$

In the example of FIG. 20, the centroid CB2 of the subpixel B2 is included in the frame pixel column (2(n+1)) and on the boundary between the frame pixel row (4m+2) and the frame pixel row (4m+3). The centroid CB2 is closer to the frame pixel column (2n+1) than the centerline along the Y-axis of the frame pixel column (2(n+1)).

The frame pixel columns (2n+1) and (2(n+1)) are two frame pixel columns that are closest in distance from the centroid CB2 of the subpixel B2. The frame pixels (2n+1, 4m+1), (2n+1, 4m+2), (2n+1, 4m+3), and (2n+1, 4(m+1)) are four frame pixels closest to the subpixel B2 in the frame pixel column (2n+1). The frame pixels (2(n+1), 4m+1), (2(n+1), 4m+2), (2(n+1), 4m+3), and (2(n+1), 4(m+1)) are four frame pixels closest to the subpixel B2 in the frame pixel column (2(n+1)). The foregoing eight frame pixels are eight frame pixels closest to the subpixel B2 in the frame pixel columns (2n+1) and (2(n+1)).

According to the foregoing formula, the weights to the frame pixels (2(n+1), 4m+2) and (2(n+1), 4m+3) closest to the subpixel B2 (the centroid thereof) are the highest and the weights to the farthest frame pixels (2n+1, 4m+1) and (2n+1, 4(m+1)) are the lowest. The weights to the other frame pixels (2(n+1), 4m+1), (2n+1, 4m+2), (2n+1, 4m+3), and (2(n+1), 4(m+1)) are the same value between the lowest value and the highest value.

Next, relations between one frame pixel and the subpixels to which the frame pixel (the relative luminance value thereof) is assigned are described. In the following, the relations of the frame pixels (2n, 4m), (2n+1, 4m), (2n, 4m+1), (2n+1, 4m+1), (2n, 4m+2), (2n+1, 4m+2), (2n, 4m+3), and (2n+1, 4m+3) are described. These frame pixels constitute a unit in a picture frame. This unit is disposed repeatedly in a plane to be a picture frame. Accordingly, the relative luminance value of a given frame pixel can be assigned in the same way as the relative luminance value of one of these eight frame pixels.

Figure 21:
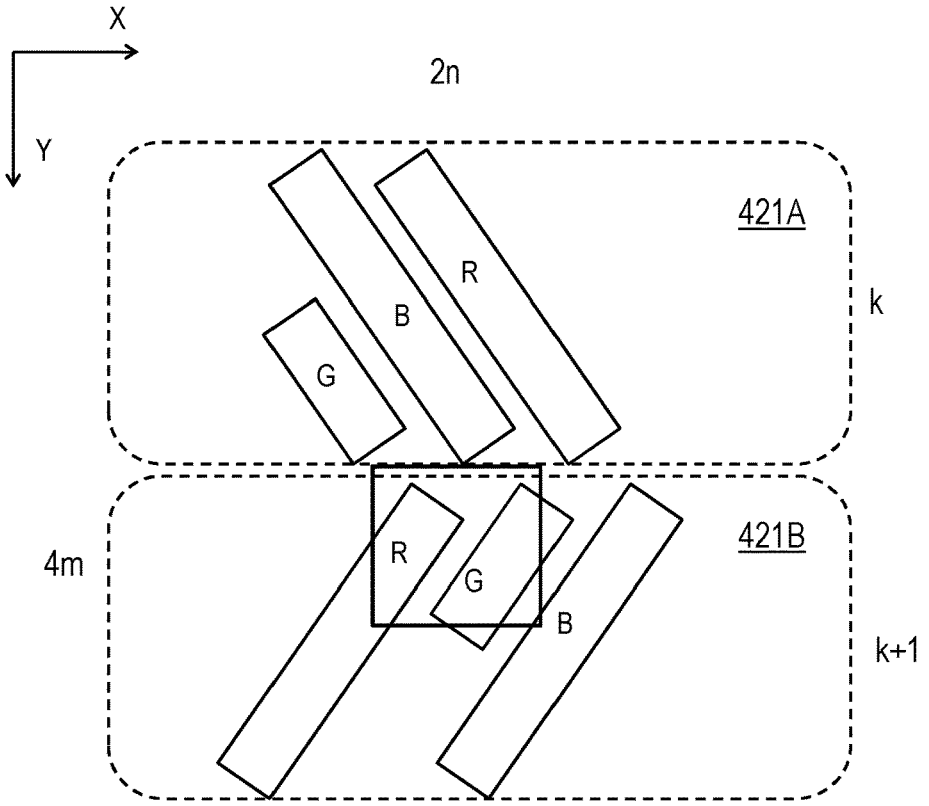
FIG. 21 illustrates a frame pixel and the subpixels to be assigned the relative luminance value of the frame pixel.

FIG. 21 illustrates the frame pixel (2n, 4m) and the subpixels to be assigned the relative luminance value of the frame pixel (2n, 4m). The relative luminance value of the frame pixel (2n, 4m) is assigned to subpixels in the subpixel rows 421A and 421B, which are the k-th and the (k+1)th subpixel rows from the top (k can be a natural number).

The subpixel rows 421A and 421B are two subpixel rows closest to the centroid of the frame pixel (2n, 4m). The distance between a subpixel row and the centroid of a frame pixel can be the distance between the centerline along the X-axis of the subpixel row and the centroid of the frame pixel. The subpixel row 421B is the subpixel row first closest to the centroid of the frame pixel (2n, 4m).

The frame pixel (2n, 4m) is associated with a red or blue subpixel or a green subpixel pair whose centroid is closest to the centroid of the frame pixel (2n, 4m) in each of the subpixel rows 421A and 421B. Further, the frame pixel (2n, 4m) is associated with two subpixels or a subpixel and a subpixel pair of different colors on both sides thereof. The relative luminance value of the frame pixel (2n, 4m) is assigned to the associated red and blue subpixels and the closer green subpixel in the associated green subpixel pair.

Specifically, the relative luminance value of the frame pixel (2n, 4m) is assigned to the closest blue subpixel B61 in the subpixel row 421A and the red subpixel R61 and the green subpixel G61 on both sides of the blue subpixel B61. The green subpixel G61 is closer to the frame pixel column (2n) in the green subpixel pair. The relative luminance value of the frame pixel (2n, 4m) is also assigned to the closest green subpixel G11 in the subpixel row 421B and the red subpixel R1 and the blue subpixel B1 on both sides of the green subpixel G11.

Figure 22:
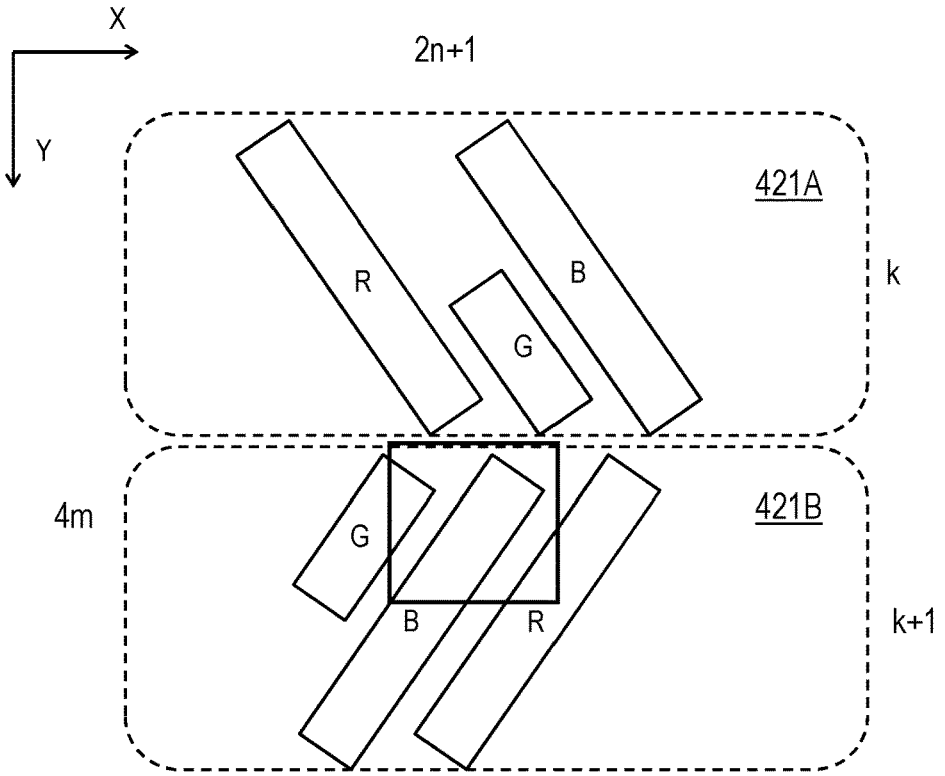
FIG. 22 illustrates another frame pixel and the subpixels to be assigned the relative luminance value of the frame pixel.

FIG. 22 illustrates the frame pixel (2n+1, 4m) and the subpixels to be assigned the relative luminance value of the frame pixel (2n+1, 4m). The relative luminance value of the frame pixel (2n+1, 4m) is assigned to subpixels in the subpixel rows 421A and 421B, which are the k-th and the (k+1)th subpixel rows from the top. The subpixel rows 421A and 421B are two subpixel rows closest to the centroid of the frame pixel (2n+1, 4m). The subpixel row 421B is the subpixel row first closest to the centroid of the frame pixel (2n+1, 4m).

The frame pixel (2n+1, 4m) is associated with a red or blue subpixel or a green subpixel pair whose centroid is closest to the centroid of the frame pixel (2n+1, 4m) in each of the subpixel rows 421A and 421B. Further, the frame pixel (2n+1, 4m) is associated with two subpixels or a subpixel and a subpixel pair of different colors on both sides thereof. The relative luminance value of the frame pixel (2n+1, 4m) is assigned to the associated red and blue subpixels and the closer green subpixel in the associated green subpixel pair.

Specifically, the relative luminance value of the frame pixel (2n+1, 4m) is assigned to the closest green subpixel G62 in the subpixel row 421A and the red subpixel R61 and the blue subpixel B62 on both sides of the green subpixel G62. The relative luminance value of the frame pixel (2n+1, 4m) is also assigned to the closest blue subpixel B1 in the subpixel row 421B and the red subpixel R62 and the closer green subpixel G11 on both sides of the blue subpixel B1. This green subpixel G11 is closer to the frame pixel column (2n+1) in the green subpixel pair.

Figure 23:
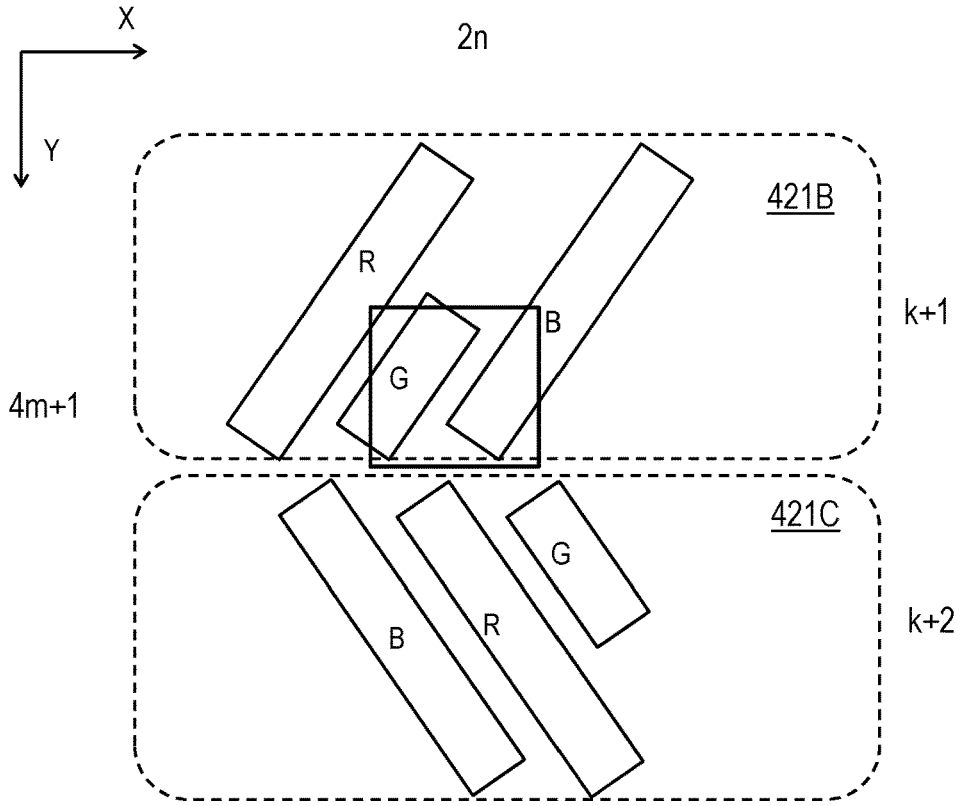
FIG. 23 illustrates still another frame pixel and the subpixels to be assigned the relative luminance value of the frame pixel.

FIG. 23 illustrates the frame pixel (2n, 4m+1) and the subpixels to be assigned the relative luminance value of the frame pixel (2n, 4m+1). The relative luminance value of the frame pixel (2n, 4m+1) is assigned to subpixels in the subpixel rows 421B and 421C, which are the (k+1)th and the (k+2)th subpixel rows from the top. The subpixel rows 421B and 421C are two subpixel rows closest to the centroid of the frame pixel (2n, 4m+1). The subpixel row 421B is the subpixel row first closest to the centroid of the frame pixel (2n, 4m+1).

The frame pixel (2n, 4m+1) is associated with a red or blue subpixel or a green subpixel pair whose centroid is closest to the centroid of the frame pixel (2n, 4m+1) in each of the subpixel rows 421B and 421C. Further, the frame pixel (2n, 4m+1) is associated with two subpixels or a subpixel and a subpixel pair of different colors on both sides thereof. The relative luminance value of the frame pixel (2n, 4m+1) is assigned to the associated red and blue subpixels and the closer green subpixel in the associated green subpixel pair.

Specifically, the relative luminance value of the frame pixel (2n, 4m+1) is assigned to the closest green subpixel G12 in the subpixel row 421B and the red subpixel R1 and the blue subpixel B1 on both sides of the green subpixel G12. The relative luminance value of the frame pixel (2n, 4m+1) is also assigned to the closest red subpixel R2 in the subpixel row 421C and the blue subpixel B63 and the closer green subpixel G21 on both sides of the red subpixel R2. This green subpixel G21 is closer to the frame pixel column (2n) in the green subpixel pair.

Figure 24:
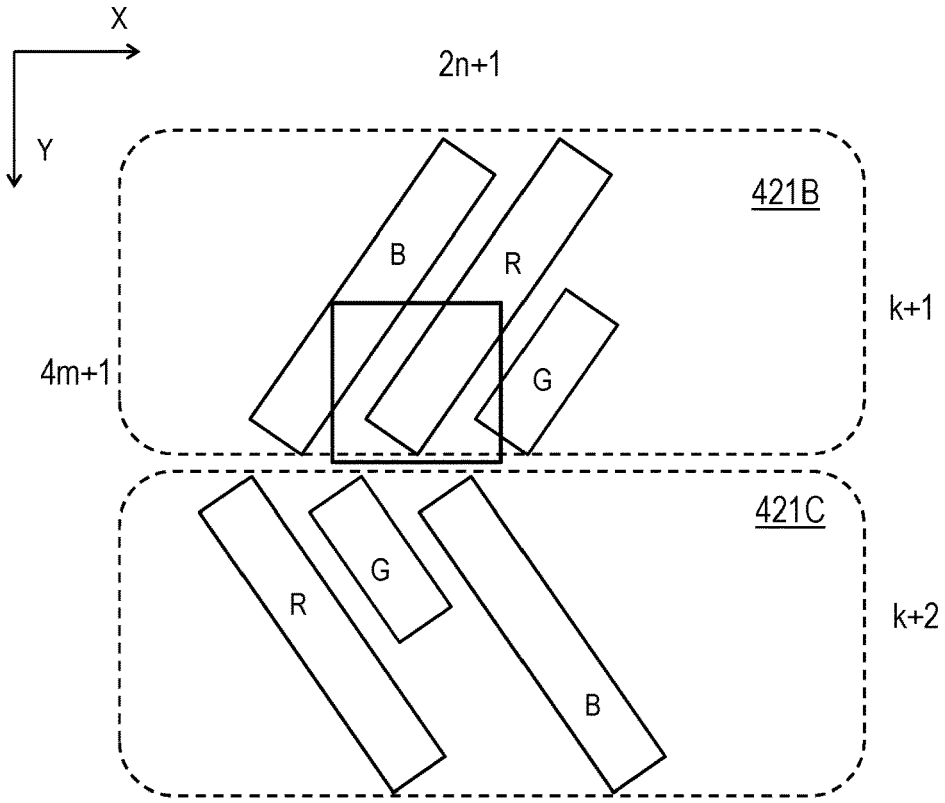
FIG. 24 illustrates still another frame pixel and the subpixels to be assigned the relative luminance value of the frame pixel.

FIG. 24 illustrates the frame pixel (2n+1, 4m+1) and the subpixels to be assigned the relative luminance value of the frame pixel (2n+1, 4m+1). The relative luminance value of the frame pixel (2n+1, 4m+1) is assigned to subpixels in the subpixel rows 421B and 421C, which are the (k+1)th and (k+2)th subpixel rows from the top. The subpixel rows 421B and 421C are two subpixel rows closest to the centroid of the frame pixel (2n+1, 4m+1). The subpixel row 421B is the subpixel row first closest to the centroid of the frame pixel (2n+1, 4m+1).

The frame pixel (2n+1, 4m+1) is associated with a red or blue subpixel or a green subpixel pair whose centroid is closest to the centroid of the frame pixel (2n+1, 4m+1) in each of the subpixel rows 421B and 421C. Further, the frame pixel (2n+1, 4m+1) is associated with two subpixels or a subpixel and a subpixel pair of different colors on both sides thereof. The relative luminance value of the frame pixel (2n+1, 4m+1) is assigned to the associated red and blue subpixels and the closer green subpixel in the associated green subpixel pair.

Specifically, the relative luminance value of the frame pixel (2n+1, 4m+1) is assigned to the closest red subpixel R62 in the subpixel row 421B and the blue subpixel B1 and the closer green subpixel G63 on both sides of the red subpixel R62. This green subpixel G63 is closer to the frame pixel column (2n+1) in the green subpixel pair. The relative luminance value of the frame pixel (2n+1, 4m+1) is also assigned to the closest green subpixel G21 in the subpixel row 421C and the red subpixel R2 and the blue subpixel B2 on both sides of the green subpixel G21.

Figure 25:
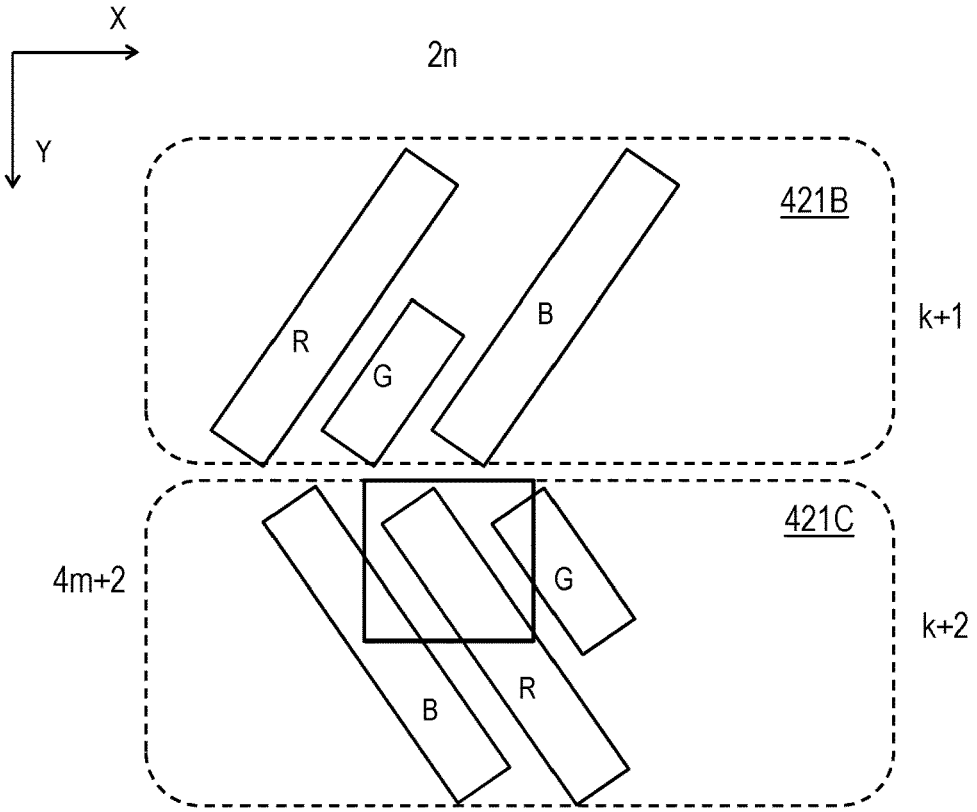
FIG. 25 illustrates still another frame pixel and the subpixels to be assigned the relative luminance value of the frame pixel.

FIG. 25 illustrates the frame pixel (2n, 4m+2) and the subpixels to be assigned the relative luminance value of the frame pixel (2n, 4m+2). The relative luminance value of the frame pixel (2n, 4m+2) is assigned to subpixels in the subpixel rows 421B and 421C, which are the (k+1)th and the (k+2)th subpixel rows from the top. The subpixel rows 421B and 421C are two subpixel rows closest to the centroid of the frame pixel (2n, 4m+2). The subpixel row 421C is the subpixel row first closest to the centroid of the frame pixel (2n, 4m+2).

The frame pixel (2n, 4m+2) is associated with a red or blue subpixel or a green subpixel pair whose centroid is closest to the centroid of the frame pixel (2n, 4m+2) in each of the subpixel rows 421B and 421C. Further, the frame pixel (2n, 4m+2) is associated with two subpixels or a subpixel and a subpixel pair of different colors on both sides thereof. The relative luminance value of the frame pixel (2n, 4m+2) is assigned to the associated red and blue subpixels and the closer green subpixel in the associated green subpixel pair.

Specifically, the relative luminance value of the frame pixel (2n, 4m+2) is assigned to the closest green subpixel G12 in the subpixel row 421B and the red subpixel R1 and the blue subpixel B1 on both sides of the green subpixel G12. The relative luminance value of the frame pixel (2n, 4m+2) is also assigned to the closest red subpixel R2 in the subpixel row 421C and the blue subpixel B63 and the closer green subpixel G21 on both sides of the red subpixel R2. This green subpixel G21 is closer to the frame pixel column (2n) in the green subpixel pair.

Figure 26:
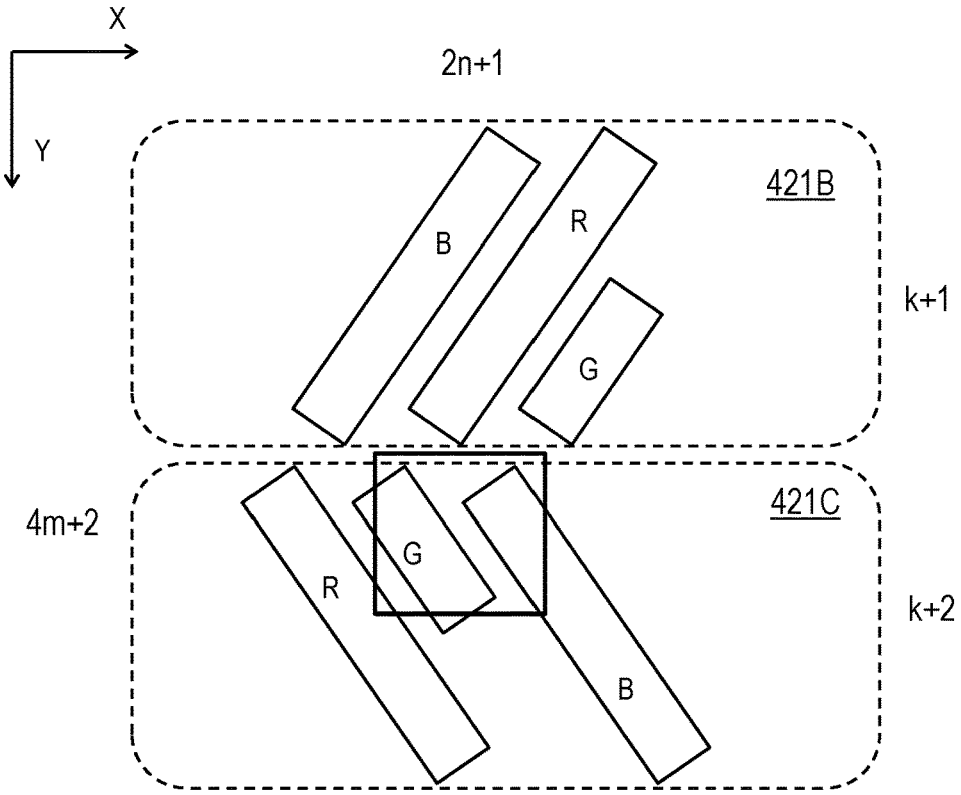
FIG. 26 illustrates still another frame pixel and the subpixels to be assigned the relative luminance value of the frame pixel.

FIG. 26 illustrates the frame pixel (2n+1, 4m+2) and the subpixels to be assigned the relative luminance value of the frame pixel (2n+1, 4m+2). The relative luminance value of the frame pixel (2n+1, 4m+2) is assigned to subpixels in the subpixel rows 421B and 421C, which are the (k+1)th and the (k+2)th subpixel rows from the top. The subpixel rows 421B and 421C are two subpixel rows closest to the centroid of the frame pixel (2n+1, 4m+2). The subpixel row 421C is the subpixel row first closest to the centroid of the frame pixel (2n+1, 4m+2).

The frame pixel (2n+1, 4m+2) is associated with a red or blue subpixel or a green subpixel pair whose centroid is closest to the centroid of the frame pixel (2n+1, 4m+2) in each of the subpixel rows 421B and 421C. Further, the frame pixel (2n+1, 4m+2) is associated with two subpixels or a subpixel and a subpixel pair of different colors on both sides thereof. The relative luminance value of the frame pixel (2n+1, 4m+2) is assigned to the associated red and blue subpixels and the closer green subpixel in the associated green subpixel pair.

Specifically, the relative luminance value of the frame pixel (2n+1, 4m+2) is assigned to the closest red subpixel R62 in the subpixel row 421B and the blue subpixel B1 and the closer green subpixel G63 on both sides of the red subpixel R62. This green subpixel G63 is closer to the frame pixel column (2n+1) in the green subpixel pair. The relative luminance value of the frame pixel (2n+1, 4m+2) is also assigned to the closest green subpixel G21 in the subpixel row 421C and the red subpixel R2 and the blue subpixel B2 on both sides of the green subpixel G21.

Figure 27:
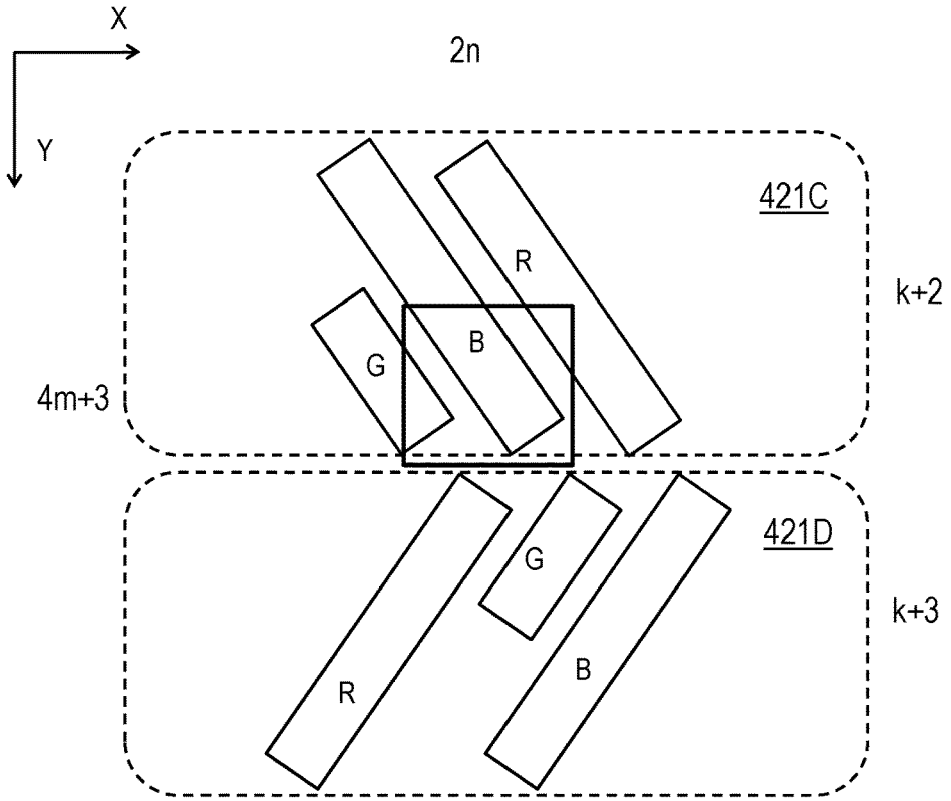
FIG. 27 illustrates still another frame pixel and the subpixels to be assigned the relative luminance value of the frame pixel.

FIG. 27 illustrates the frame pixel (2n, 4m+3) and the subpixels to be assigned the relative luminance value of the frame pixel (2n, 4m+3). The relative luminance value of the frame pixel (2n, 4m+3) is assigned to subpixels in the subpixel rows 421C and 421D, which are the (k+2)th and the (k+3)th subpixel rows from the top. The subpixel rows 421C and 421D are two subpixel rows closest to the centroid of the frame pixel (2n, 4m+3). The subpixel row 421C is the subpixel row first closest to the centroid of the frame pixel (2n, 4m+3).

The frame pixel (2n, 4m+3) is associated with a red or blue subpixel or a green subpixel pair whose centroid is closest to the centroid of the frame pixel (2n, 4m+3) in each of the subpixel rows 421C and 421D. Further, the frame pixel (2n, 4m+3) is associated with two subpixels or a subpixel and a subpixel pair of different colors on both sides thereof. The relative luminance value of the frame pixel (2n, 4m+3) is assigned to the associated red and blue subpixels and the closer green subpixel in the associated green subpixel pair.

Specifically, the relative luminance value of the frame pixel (2n, 4m+3) is assigned to the closest blue subpixel B63 in the subpixel row 421C and the red subpixel R2 and the closer green subpixel G64 on both sides of the blue subpixel B63. This green subpixel G64 is closer to the frame pixel column (2n) in the green subpixel pair. The relative luminance value of the frame pixel (2n, 4m+3) is also assigned to the closest green subpixel G65 in the subpixel row 421D and the red subpixel R63 and the blue subpixel B64 on both sides of the green subpixel G65.

Figure 28:
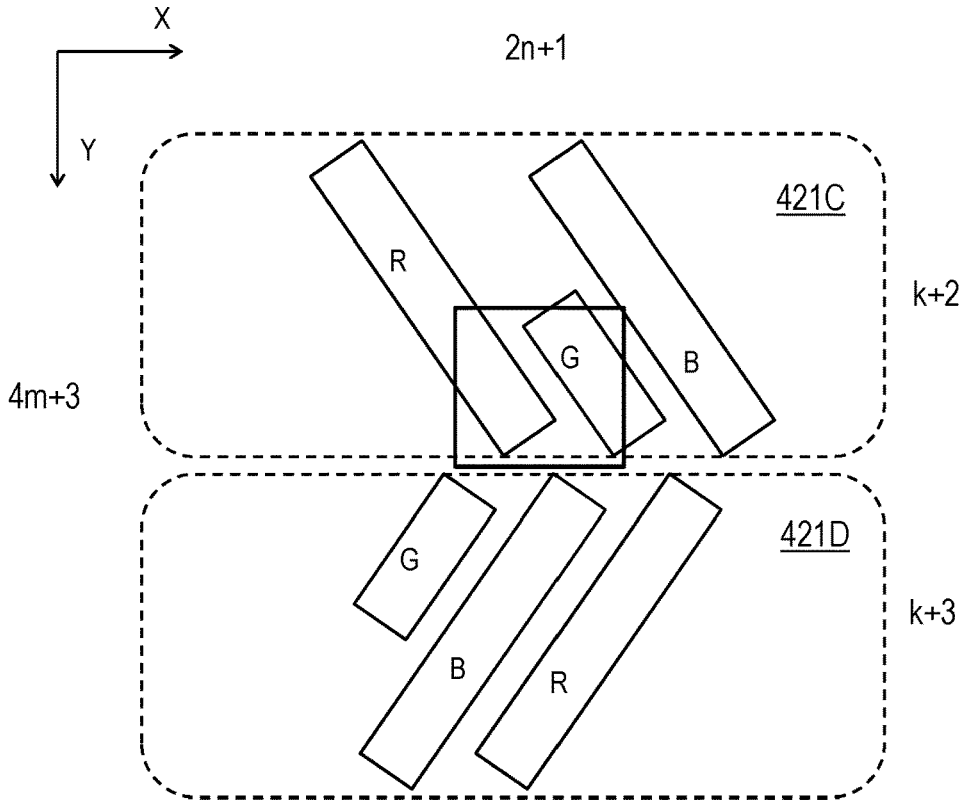
FIG. 28 illustrates still another frame pixel and the subpixels to be assigned the relative luminance value of the frame pixel.

FIG. 28 illustrates the frame pixel (2n+1, 4m+3) and the subpixels to be assigned the relative luminance value of the frame pixel (2n+1, 4m+3). The relative luminance value of the frame pixel (2n+1, 4m+3) is assigned to subpixels in the subpixel rows 421C and 421D, which are the (k+2)th and the (k+3)th subpixel rows from the top. The subpixel rows 421C and 421D are two subpixel rows closest to the centroid of the frame pixel (2n+1, 4m+3). The subpixel row 421C is the subpixel row first closest to the centroid of the frame pixel (2n+1, 4m+3).

The frame pixel (2n+1, 4m+3) is associated with a red or blue subpixel or a green subpixel pair whose centroid is closest to the centroid of the frame pixel (2n+1, 4m+3) in each of the subpixel rows 421C and 421D. Further, the frame pixel (2n+1, 4m+3) is associated with two subpixels or a subpixel and a subpixel pair of different colors on both sides thereof. The relative luminance value of the frame pixel (2n+1, 4m+3) is assigned to the associated red and blue subpixels and the closer green subpixel in the associated green subpixel pair.

Specifically, the relative luminance value of the frame pixel (2n+1, 4m+3) is assigned to the closest green subpixel G22 in the subpixel row 421C and the red subpixel R2 and the blue subpixel B2 on both sides of the green subpixel G22. The relative luminance value of the frame pixel (2n+1, 4m+3) is also assigned to the closest blue subpixel B64 in the subpixel row 421D and the red subpixel R64 and the green subpixel G65 on both sides of the blue subpixel B64. This green subpixel G65 is closer to the frame pixel column (2n+1) in the green subpixel pair.

Next, a method of determining the relative luminance values for individual subpixels in an OLED display device in the case where the luminance values (relative luminance values) of the outer green subpixels in the green subpixel pairs on both sides of a white line of one frame pixel column are greater than zero is described.

Determining the relative luminance values for the red subpixels and blue subpixels is the same as described with reference to FIGS. 15 to 28, which is the method in the case where the luminance values of the outer green subpixels are zero. Determining the relative luminance values for green subpixels is different from the above-described example.

Figure 29:
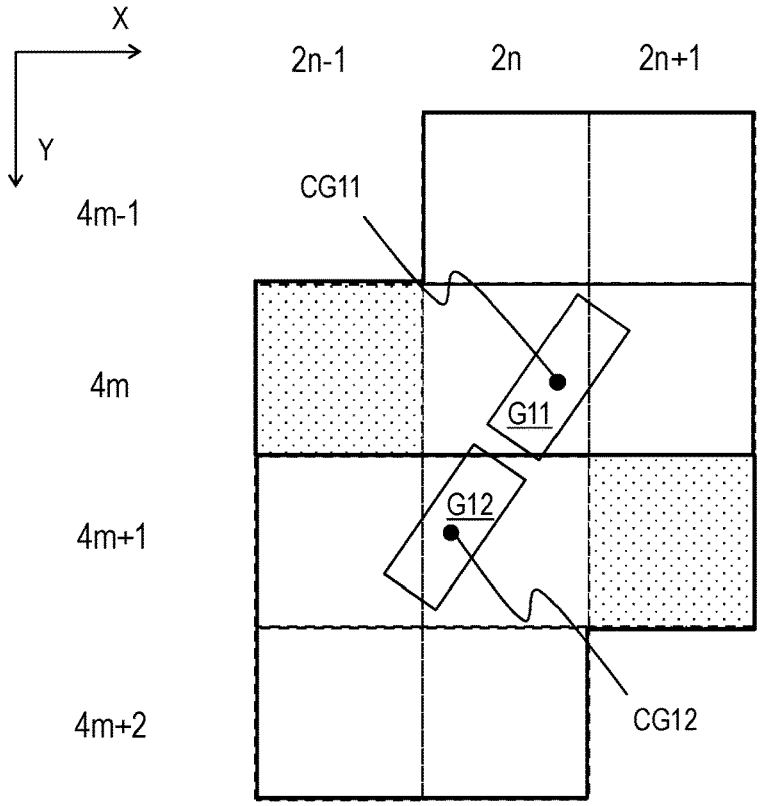
FIG. 29 illustrates green subpixels and the frame pixels to assign their relative luminance values to the subpixels.

FIG. 29 illustrates the green subpixels G11 and G12 and the frame pixels to assign their relative luminance values to the subpixels G11 and G12. The subpixel G11 is assigned the relative luminance values of two adjacent frame pixels (2n, 4m−1) and (2n+1, 4m−1) in the frame pixel row (4m−1). Further, the subpixel G11 is assigned the relative luminance values of three consecutive frame pixels (2n−1, 4m), (2n, 4m), and (2n+1, 4m) in the frame pixel row (4m). Compared to the example of FIG. 16, the frame pixel (2n−1, 4m) is added.

The relative luminance value LG11 of the subpixel G11 can be expressed as the following formula:

$$LG11=LGin(2n,4m-1)*(15/48)+LGin(2n+1,4m-1)*(1/48)+LGin(2n-1,4m)*(1/48)+LGin(2n,4m)*(23/48)+LGin(2n+1,4m)*(8/48).$$

In the example of FIG. 29, the centroid CG11 of the subpixel G11 is included in the frame pixel row (4m) and the frame pixel column (2n), namely, the frame pixel (2n, 4m). The centroid CG11 is closer to the frame pixel column (2n+1) than the centerline along the Y-axis of the frame pixel column (2n).

The frame pixel row (4m) is the frame pixel row that is closest from the centroid CG11 of the subpixel G11. The frame pixel (2n, 4m) is the frame pixel closest to the centroid CG11 of the subpixel G11 in the frame pixel row (4m) and the frame pixels (2n−1, 4m) and (2n+1, 4m) are the frame pixels on both sides of the frame pixel (2n, 4m).

The frame pixel row (4m−1) is adjacent to the frame pixel row (4m) on the opposite side of the subpixel G12. The frame pixels (2n, 4m−1) and (2n+1, 4m−1) are two frame pixels closest to the centroid CG11 of the subpixel G11 in the frame pixel row (4m−1).

According to the foregoing formula, the weight to the frame pixel (2n, 4m) closest to the green subpixel G11 (the centroid thereof) is the highest. In the frame pixel row (4m), the weight to the second closest frame pixel (2n+1, 4m) is the second highest and the weight to the farthest frame pixel (2n−1, 4m) is the lowest. In the frame pixel row (4m−1), the weight to the frame pixel (2n, 4m−1) closer to the green subpixel G11 (the centroid thereof) is higher than the weight to the farther frame pixel (2n+1, 4m−1).

The subpixel G12 is assigned the relative luminance values of three consecutive frame pixels (2n−1, 4m+1), (2n, 4m+1), and (2n+1, 4m+1) in the frame pixel row (4m+1). Further, the subpixel G12 is assigned the relative luminance values of two adjacent frame pixels (2n−1, 4m+2) and (2n, 4m+2) in the frame pixel row (4m+2). Compared to the example in FIG. 16, the frame pixel (2n+1, 4m+1) is added.

The relative luminance value LG12 of the subpixel G12 can be expressed as the following formula:

$$LG12=LG\text{in}(2n-1,4m+1)*(8/48)+LG\text{in}(2n,4m+1)*(23/48)+LG\text{in}(2n+1,4m+1)*(1/48)+LG\text{in}(2n-1,4m+2)*(1/48)+LG\text{in}(2n,4m+2)*(15/48).$$

In the example of FIG. 29, the centroid CG12 of the subpixel G12 is included in the frame pixel row (4m+1) and the frame pixel column (2n), namely, the frame pixel (2n, 4m+1). The centroid CG12 is closer to the frame pixel column (2n−1) than the centerline along the Y-axis of the frame pixel column (2n).

The frame pixel row (4m+1) is the frame pixel row that is closest from the centroid CG12 of the subpixel G12. The frame pixel (2n, 4m+1) is the frame pixel closest to the centroid CG12 of the subpixel G12 and the frame pixels (2n−1, 4m+1) and (2n+1, 4m+1) are the frame pixels on both sides of the frame pixel (2n, 4m+1).

The frame pixel row (4m+2) is adjacent to the frame pixel row (4m+1) on the opposite side of the subpixel G11. The frame pixels (2n−1, 4m+2) and (2n, 4m+2) are two frame pixels closest to the centroid CG12 of the subpixel G12 in the frame pixel row (4m+2).

According to the foregoing formula, the weight to the frame pixel (2n, 4m+1) closest to the green subpixel G12 (the centroid thereof) is the highest. In the frame pixel row (4m+1), the weight to the second closest frame pixel (2n−1, 4m+1) is the second highest and the weight to the farthest frame pixel (2n+1, 4m+1) is the lowest. In the frame pixel row (4m+2), the weight to the frame pixel (2n, 4m+2) closer to the green subpixel G12 (the centroid thereof) is higher than the weight to the farther frame pixel (2n−1, 4m+2).

Figure 30:
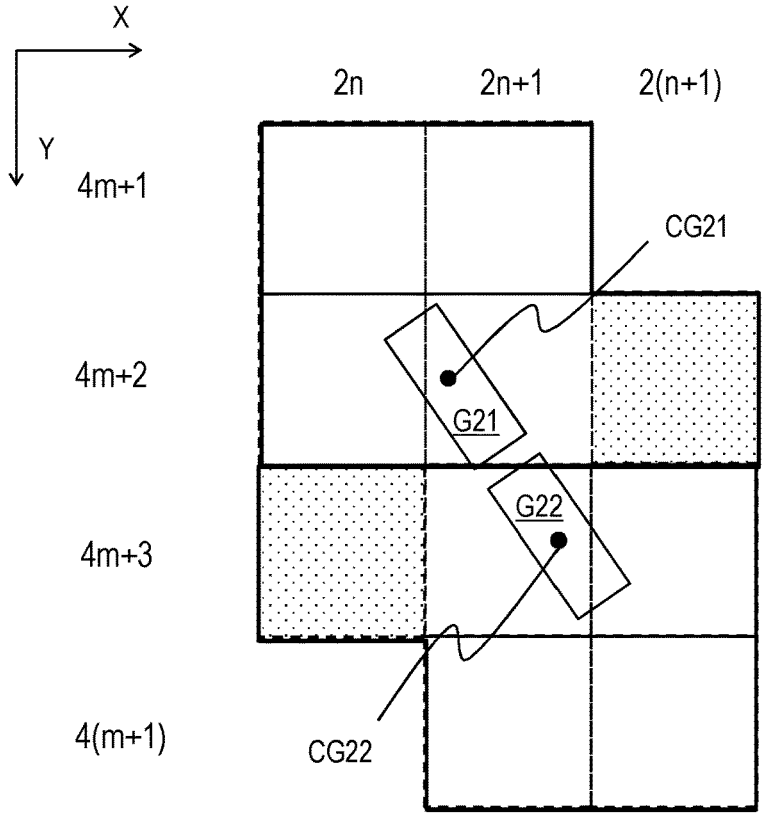
FIG. 30 illustrates other green subpixels and the frame pixels to assign their relative luminance values to the subpixels.

FIG. 30 illustrates the green subpixels G21 and G22 and the frame pixels to assign their relative luminance values to the subpixels G21 and G22. The subpixel G21 is assigned the relative luminance values of two adjacent frame pixels (2n, 4m+1) and (2n+1, 4m+1) in the frame pixel row (4m+1).

Further, the subpixel G21 is assigned the relative luminance values of three consecutive frame pixels (2n, 4m+2), (2n+1, 4m+2), and (2(n+1), 4m+2) in the frame pixel row (4m+2). Compared to the example in FIG. 19, the frame pixel (2(n+1), 4m+2) is added.

The relative luminance value LG21 of the subpixel G21 can be expressed as the following formula:

$$LG21=LG\text{in}(2n,4m+1)*(1/48)+LG\text{in}(2n+1,4m+1)*(15/48)+LG\text{in}(2n,4m+2)*(8/48)+LG\text{in}(2n+1,4m+2)*(12/48)+LG\text{in}(2(n+1),4m+2)*(1/48).$$

In the example of FIG. 30, the centroid CG21 of the subpixel G21 is included in the frame pixel row (4m+2) and the frame pixel column (2n+1), namely, the frame pixel (2n+1, 4m+2). The centroid CG21 is closer to the frame pixel column (2n) than the centerline along the Y-axis of the frame pixel column (2n+1).

The frame pixel row (4m+2) is the frame pixel row that is closest from the centroid CG21 of the subpixel G21. The frame pixel (2n+1, 4m+2) is the frame pixel closest to the centroid CG21 of the subpixel G21 in the frame pixel row (4m+2) and the frame pixels (2n, 4m+2) and (2(n+1), 4m+2) are the frame pixels on both sides of the frame pixel (2n+1, 4m+2).

The frame pixel row (4m+1) is adjacent to the frame pixel row (4m+2) on the opposite side of the subpixel G22. The frame pixels (2n, 4m+1) and (2n+1, 4m+1) are two frame pixels closest to the centroid CG21 of the subpixel G21 in the frame pixel row (4m+1).

According to the foregoing formula, the weight to the frame pixel (2n+1, 4m+2) closest to the green subpixel G21 (the centroid thereof) is the highest. In the frame pixel (4m+2), the weight to the second closest frame pixel (2n, 4m+2) is the second highest and the weight to the farthest frame pixel (2n+1), 4m+2) is the lowest. In the frame pixel row (4m+1), the weight to the frame pixel (2n+1, 4m+1) closer to the green subpixel G21 (the centroid thereof) is higher than the weight to the farther frame pixel (2n, 4m+1).

The subpixel G22 is assigned the relative luminance values of three consecutive frame pixels (2n, 4m+3), (2n+1, 4m+3), and (2(n+1), 4m+3) in the frame pixel row (4m+3). Further, the subpixel G22 is assigned the relative luminance values of two adjacent frame pixels (2n+1, 4(m+1)) and (2(n+1), 4(m+1)) in the frame pixel row (4(m+1)). Compared to the example in FIG. 19, the frame pixel (2n, 4m+3) is added.

The relative luminance value LG22 of the subpixel G22 can be expressed as the following formula:

$$LG22=LG\text{in}(2n,4m+3)*(1/48)+LG\text{in}(2n+1,4m+3)*(23/48)+LG\text{in}(2(n+1),4m+3)*(8/48)+LG\text{in}(2n+1,4(m+1))*(15/48)+LG\text{in}(2(n+1),4(m+1))*(1/48).$$

In the example of FIG. 30, the centroid CG22 of the subpixel G22 is included in the frame pixel row (4m+3) and the frame pixel column (2n+1), namely, the frame pixel (2n+1, 4m+3). The centroid CG22 is closer to the frame pixel column (2(n+1)) than the centerline along the Y-axis of the frame pixel column (2n+1).

The frame pixel row (4m+3) is the frame pixel row that is closest from the centroid CG22 of the subpixel G22. The frame pixel (2n+1, 4m+3) is the frame pixel closest to the centroid CG22 of the subpixel G22 in the frame pixel row (4m+3) and the subpixels (2n, 4m+3) and (2(n+1), 4m+3) are the frame pixels on both sides of the frame pixel (2n+1, 4m+3).

The frame pixel row (4(m+1)) is adjacent to the frame pixel row (4m+3) on the opposite side of the subpixel G21. The frame pixels (2n+1, 4(m+1)) and (2(n+1), 4(m+1)) are two frame pixels closest to the centroid CG22 of the subpixel G22 in the frame pixel row (4(m+1)).

According to the foregoing formula, the weight to the frame pixel (2n+1, 4m+3) closest to the green subpixel G22 (the centroid thereof) is the highest. In the frame pixel row (4m+3), the weight to the next closest frame pixel (2(n+1), 4m+3) is the next highest and the weight to the farthest frame pixel (2n, 4m+3) is the lowest. In the frame pixel row (4(m+1)), the weight to the frame pixel (2n+1, 4(m+1)) closer to the green subpixel G22 (the centroid thereof) is higher than the weight to the farther frame pixel (2(n+1), 4(m+1)).

Next, relations between one frame pixel and the subpixels to which the frame pixel (the relative luminance value thereof) is assigned are described. In the following, the relations of the frame pixels (2n+1, 4m), (2n+1, 4m+1), (2n, 4m+2), and (2n+1, 4m+3), which employ different assignment from the assignment described with reference to FIGS. 21 to 28, are described.

Figure 31:
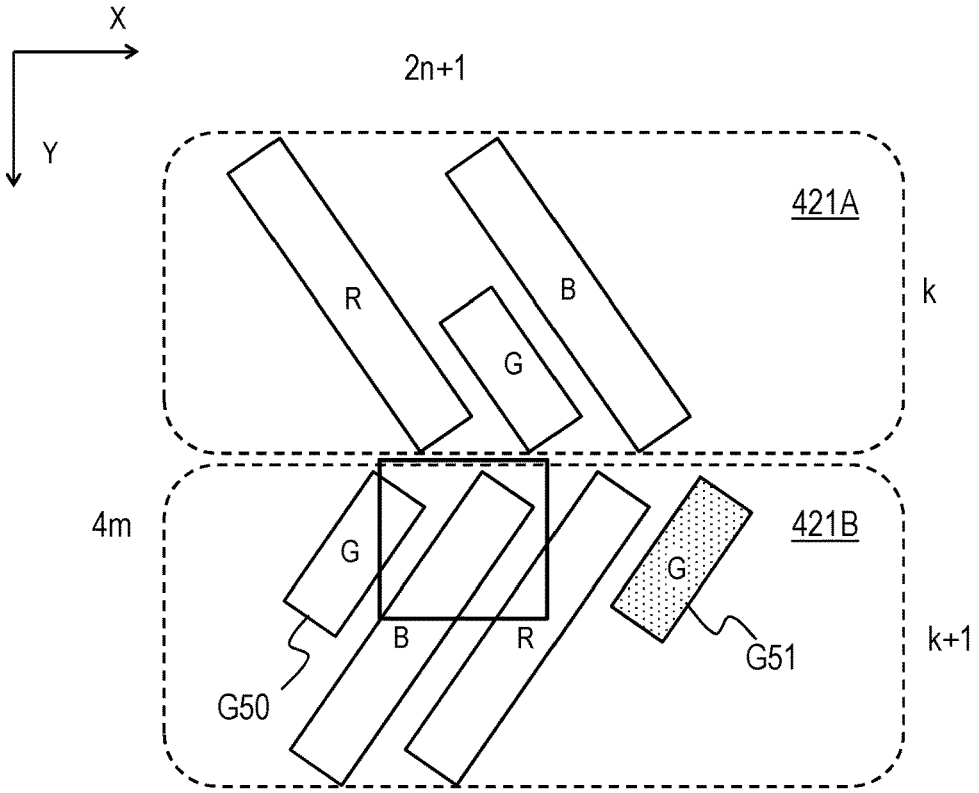
FIG. 31 illustrates a frame pixel and the subpixels to be assigned the relative luminance value of the frame pixel.

FIG. 31 illustrates the frame pixel (2n+1, 4m) and the subpixels to be assigned the relative luminance value of the frame pixel (2n+1, 4m). Another green subpixel G51 in the subpixel row 421B is added to the subpixels in FIG. 22. The frame pixel (2n+1, 4m) is sandwiched between the green subpixels G11 and G51 in the subpixel row 421B. Among only the green subpixels in the subpixel row 421B, the green subpixel G51 is adjacent to the green subpixel G11.

The added green subpixel G51 is farther from the frame pixel column (2n+1) in the green subpixel pair. The centroid of the green subpixel G51 has the same Y-coordinate as the centroid of another green subpixel G11 to be assigned the relative luminance value of the frame pixel (2n+1, 4m). A red subpixel and a blue subpixel are sandwiched between these two green subpixels G11 and G51.

Figure 32:
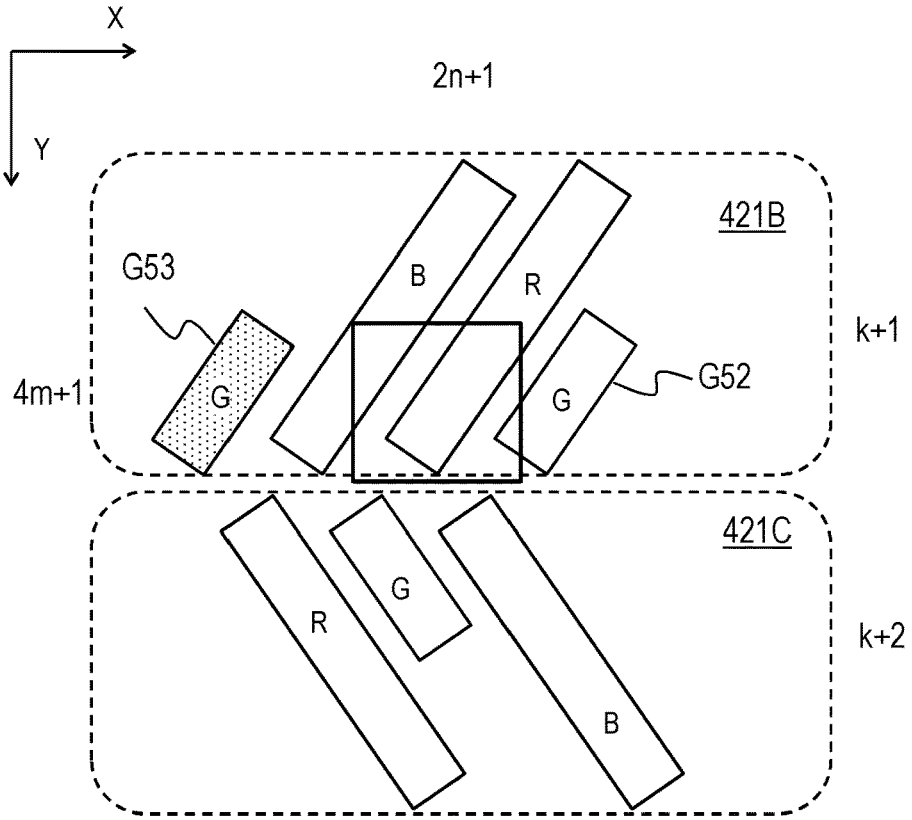
FIG. 32 illustrates another frame pixel and the subpixels to be assigned the relative luminance value of the frame pixel.

FIG. 32 illustrates the frame pixel (2n+1, 4m+1) and the subpixels to be assigned the relative luminance value of the frame pixel (2n+1, 4m+1). Another green subpixel G12 in the subpixel row 421B is added to the subpixels in FIG. 24. The frame pixel (2n+1, 4m+1) is sandwiched between the green subpixels G63 and G12 in the subpixel row 421B. Among only the green subpixels in the subpixel row 421B, the green subpixel G12 is adjacent to the green subpixel G63.

The added green subpixel G12 is farther from the frame pixel column (2n+1) in the green subpixel pair. The centroid of the green subpixel G12 has the same Y-coordinate as the centroid of another green subpixel G63 to be assigned the relative luminance value of the frame pixel (2n+1, 4m+1). A red subpixel and a blue subpixel are sandwiched between these two green subpixels G63 and G12.

Figure 33:
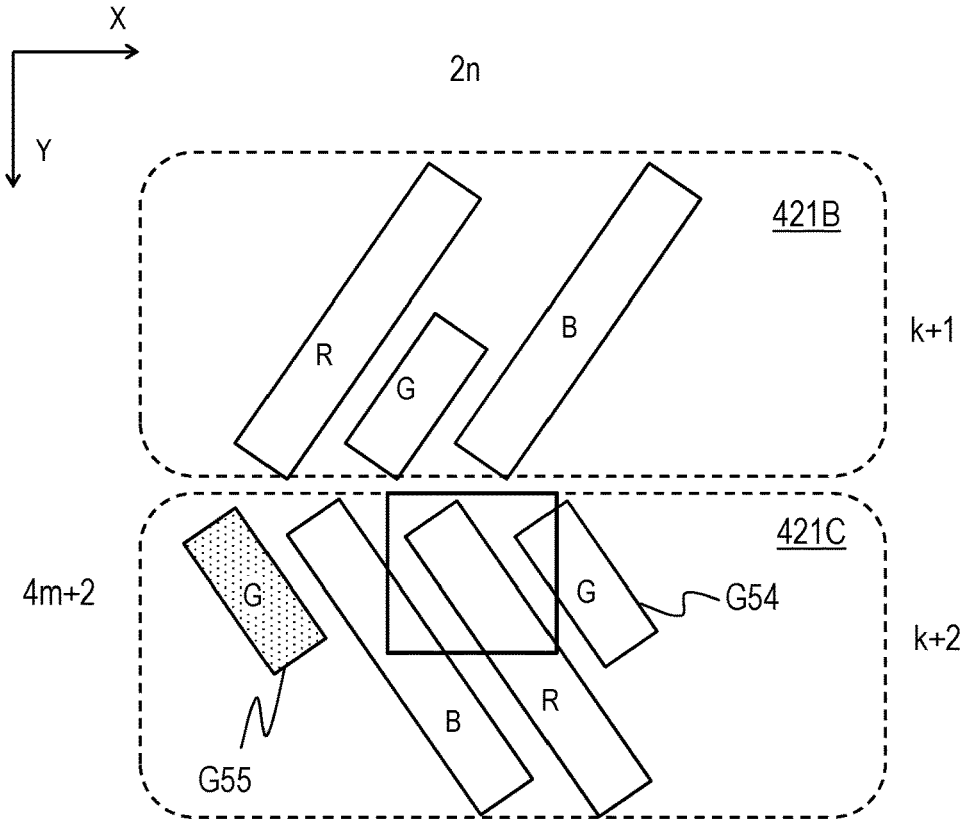
FIG. 33 illustrates still another frame pixel and the subpixels to be assigned the relative luminance value of the frame pixel.

FIG. 33 illustrates the frame pixel (2n, 4m+2) and the subpixels to be assigned the relative luminance value of the frame pixel (2n, 4m+2). Another green subpixel G55 in the subpixel row 421C is added to the subpixels in FIG. 25. The frame pixel (2n, 4m+2) is sandwiched between the green subpixels G21 and G55 in the subpixel row 421C. Among only the green subpixels in the subpixel row 421C, the green subpixel G55 is adjacent to the green subpixel G21.

The added green subpixel G55 is farther from the frame pixel column (2n) in the green subpixel pair. The centroid of the green subpixel G55 has the same Y-coordinate as the centroid of another green subpixel G21 to be assigned the relative luminance value of the frame pixel (2n, 4m+2). A red subpixel and a blue subpixel are sandwiched between these two green subpixels G21 and G55.

Figure 34:
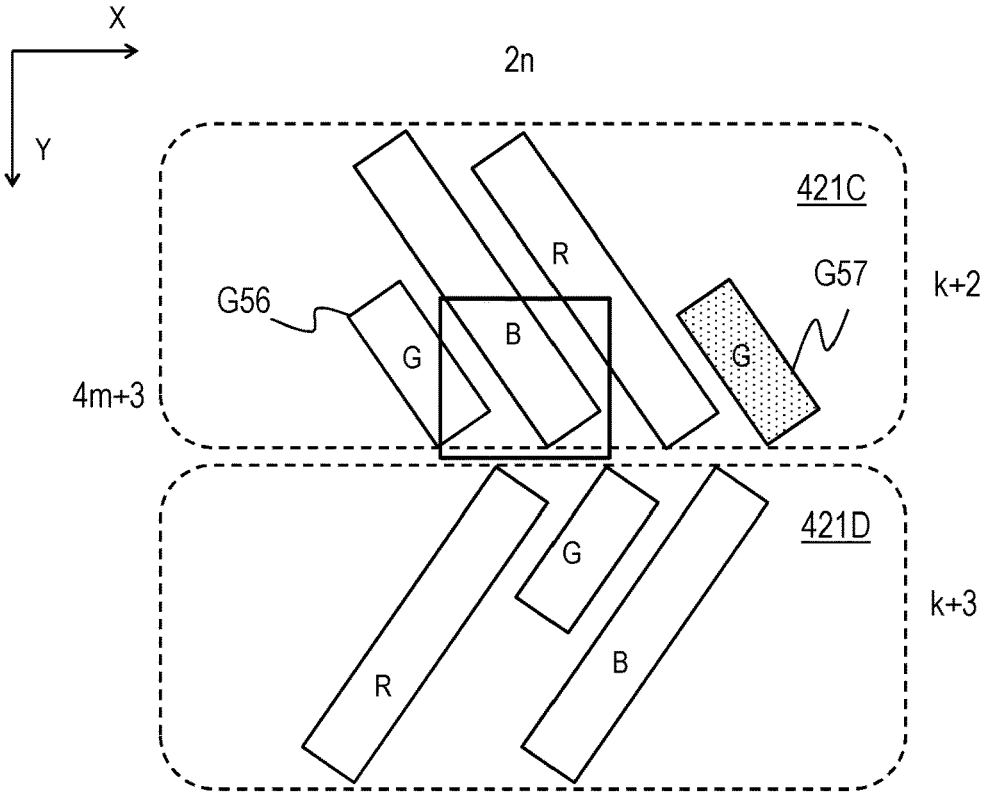
FIG. 34 illustrates still another frame pixel and the subpixels to be assigned the relative luminance value of the frame pixel.

FIG. 34 illustrates the frame pixel (2n, 4m+3) and the subpixels to be assigned the relative luminance value of the frame pixel (2n, 4m+3). Another green subpixel G22 in the subpixel row 421C is added to the subpixels in FIG. 27. The frame pixel (2n, 4m+3) is sandwiched between the green subpixels G64 and G22 in the subpixel row 421C. Among only the green subpixels in the subpixel row 421C, the green subpixel G22 is adjacent to the green subpixel G64.

The added green subpixel G22 is farther from the frame pixel column (2n) in the green subpixel pair. The centroid of the green subpixel G22 has the same Y-coordinate as the centroid of another green subpixel G64 to be assigned the relative luminance value of the frame pixel (2n, 4m+3). A red subpixel and a blue subpixel are sandwiched between these two green subpixels G64 and G22.

As set forth above, embodiments of this disclosure have been described; however, this disclosure is not limited to the foregoing embodiments. Those skilled in the art can easily modify, add, or convert each element in the foregoing embodiment within the scope of this disclosure. A part of the configuration of one embodiment can be replaced with a configuration of another embodiment or a configuration of an embodiment can be incorporated into a configuration of another embodiment.

What is claimed is:

1. A display device, comprising:

a substrate; and a display region fabricated on the substrate, wherein the display region includes a plurality of subpixel lines, wherein each of the plurality of subpixel lines includes subpixels of a first color, subpixel pairs of a second color, and subpixels of a third color disposed cyclically one by one along a first axis, centroids of the subpixels of the first color, the subpixels of the third color and the subpixel pairs of the second color being located on a straight line along the first axis, wherein, between two adjacent subpixel lines, subpixels of the first color are disposed at different positions along the first axis, wherein, between the two adjacent subpixel lines, subpixel pairs of the second color are disposed at different positions along the first axis, wherein, between the two adjacent subpixel lines, subpixels of the third color are disposed at different positions along the first axis, and wherein the centroids of two subpixels constituting a subpixel pair of the second color are located at different positions along the first axis and along a second axis perpendicular to the first axis, wherein each subpixel pair of the second color consists of a first subpixel on a left side of a line extending in the first axis direction and a second subpixel on a right side of the line extending in the first axis direction, wherein, in one of the two adjacent subpixel lines, the centroid of the first subpixel is located on a left side of a line extending in the second axis direction and through the centroid of the subpixel pair and the centroid of the second subpixel is located on a right side of the line extending in the second axis direction and through the centroid of the subpixel pair, wherein, in the other one of the two adjacent subpixel lines, the centroid of the first subpixel is located on a right side of a line extending in the second axis direction and through the centroid of the subpixel pair and the centroid of the second subpixel is located on a left side of the line extending in the second axis direction and through the centroid of the subpixel pair, wherein the subpixels of the first color, the subpixel pairs of the second color, and the subpixels of the third color have the same shape, and wherein the subpixels of the first color, the subpixel pairs of the second color, and the subpixels of the third color in one of the two adjacent subpixel lines are tilted in one direction with respect to the second axis, and the subpixels of the first color, the subpixel pairs of the second color, and the subpixels of the third color in the other one of the two adjacent subpixel lines are tilted in another direction with respect to the second axis.

2. The display device according to claim 1, wherein the second color has higher relative visibility than the first color and the third color.

3. The display device according to claim 1, wherein two subpixels constituting a subpixel pair of the second color are point-symmetric about the center between the centroids of the two subpixels.

4. The display device according to claim 1, wherein each of the two subpixels constituting a subpixel pair of the second color is equally distant from the subpixel of the first color or the third color adjacent to the two subpixels in the same subpixel line including the two subpixels.

5. The display device according to claim 1, wherein the display device displays a white line along the second axis, wherein the white line is composed of first subpixel groups and second subpixel groups disposed alternately along the second axis and each of the first subpixel groups and the second subpixel groups is composed of subpixels in one subpixel line, wherein the first subpixel group consists of two adjacent subpixel pairs of the second color and a subpixel of the first color and a subpixel of a third color sandwiched between the two adjacent subpixel pairs of the second color, wherein the second subpixel group consists of one subpixel pair of the second color and a subpixel of the first color and a subpixel of a second color adjacent to the one subpixel pair of the second color, wherein the one subpixel pair of the second color in the second subpixel group is lighted at luminance higher than the two adjacent subpixel pairs of the second color in the first subpixel group, wherein, in each of the two adjacent subpixel pairs of the second color, one subpixel is lighted at luminance higher than the other subpixel, and wherein distance along the first axis between the centroid of the one subpixel and the centroid of the one subpixel pair of the second color in the second subpixel group is shorter than distance along the first axis between the centroid of the other subpixel and the centroid of the one subpixel pair of the second color in the second subpixel group.

6. The display device according to claim 1, wherein intervals between virtual lines along the second axis that pass through the centroids of subpixels in subpixel pairs of the second color are equal.

7. The display device according to claim 1, further comprising:

a circuit configured to determine relative luminance of individual subpixels of the first color, the second color, and the third color from relative luminance of individual frame pixels included in a picture frame, wherein the picture frame includes frame pixels disposed along the first axis and the second axis in a matrix, wherein the subpixel pair of the second color consists of a first subpixel of the second color and a second subpixel of the second color, wherein the circuit is configured to:

determine relative luminance of a subpixel of the first color from relative luminance of eight frame pixels closest from the centroid of the subpixel of the first color in two frame pixel lines along the second axis that is closest from the centroid of the subpixel of the first color;

determine relative luminance of a subpixel of the third color from relative luminance of eight frame pixels closest from the centroid of the subpixel of the third color in two frame pixel lines along the second axis that is closest from the centroid of the subpixel of the third color;

determine relative luminance of a first subpixel of the second color from relative luminance of two frame pixels closest from the centroid of the first subpixel of the second color in a first frame pixel line along the first axis that is closest from the centroid of the first subpixel of the second color and relative luminance of two frame pixels closest from the centroid of the first subpixel of the second color in the frame pixel line along the first axis that is adjacent to the first frame pixel line on the opposite side of the second subpixel of the second color; and determine relative luminance of a second subpixel of the second color from relative luminance of two frame pixels closest from the centroid of the second subpixel of the second color in a second frame pixel line along the first axis that is closest from the centroid of the second subpixel of the second color and relative luminance of two frame pixels closest from the centroid of the second subpixel of the second color in the frame pixel line along the first axis that is adjacent to the second frame pixel line on the opposite side of the first subpixel of the second color.

8. The display device according to claim 1, further comprising:

a circuit configured to determine relative luminance of individual subpixels of the first color, the second color, and the third color from relative luminance of individual frame pixels included in a picture frame, wherein the picture frame includes frame pixels disposed along the first axis and the second axis in a matrix, wherein the subpixel pair of the second color consists of a first subpixel of the second color and a second subpixel of the second color, wherein the circuit is configured to:

determine relative luminance of a subpixel of the first color from relative luminance of eight frame pixels closest from the centroid of the subpixel of the first color in two frame pixel lines along the second axis that is closest from the centroid of the subpixel of the first color;

determine relative luminance of a subpixel of the third color from relative luminance of eight frame pixels closest from the centroid of the subpixel of the third color in two frame pixel lines along the second axis that is closest from the centroid of the subpixel of the third color;

determine relative luminance of a first subpixel of the second color from relative luminance of a frame pixel closest from the centroid of the first subpixel of the second color and frame pixels on both sides of the closest frame pixel in a first frame pixel line along the first axis that is closest from the centroid of the first subpixel of the second color and relative luminance of two frame pixels closest from the centroid of the first subpixel of the second color in the frame pixel line along the first axis that is adjacent to the first frame pixel line on the opposite side of the second subpixel of the second color; and determine relative luminance of a second subpixel of the second color from relative luminance of a frame pixel closest from the centroid of the second subpixel of the second color and frame pixels on both sides of the closest frame pixel in a second frame pixel line along the first axis that is closest from the centroid of the second subpixel of the second color and relative luminance of two frame pixels closest from the centroid of the second subpixel of the second color in the frame pixel line along the first axis that is adjacent to the second frame pixel line on the opposite side of the first subpixel of the second color.

* * * * *